US012078400B2

(12) United States Patent
Cao

(10) Patent No.: US 12,078,400 B2
(45) Date of Patent: Sep. 3, 2024

(54) MINIATURE JOULE-THOMSON CRYOCOOLER OPERATING AT LIQUID HELIUM TEMPERATURES

(71) Applicant: Tsinghua University, Beijing (CN)

(72) Inventor: Haishan Cao, Beijing (CN)

(73) Assignee: TSINGHUA UNIVERSITY, Beijing (CN)

( * ) Notice: Subject to any disclaimer, the term of this patent is extended or adjusted under 35 U.S.C. 154(b) by 478 days.

(21) Appl. No.: 17/412,620

(22) Filed: Aug. 26, 2021

(65) Prior Publication Data

US 2022/0170672 A1 Jun. 2, 2022

(30) Foreign Application Priority Data

Nov. 29, 2020 (CN) ..... 202011366114.X
Nov. 29, 2020 (CN) ..... 202011366136.6

(51) Int. Cl.
*F25B 9/02* (2006.01)

(52) U.S. Cl.
CPC ..... *F25B 9/02* (2013.01); *F25B 2309/022* (2013.01)

(58) Field of Classification Search
CPC .. F25B 9/02; F25B 2309/022; F25B 2309/02; F25B 2400/15; F25B 9/10; F28D 2021/0033
USPC ..... 62/51.2
See application file for complete search history.

(56) References Cited

U.S. PATENT DOCUMENTS 4,386,505 A * 6/1983 Little ..... F25B 39/022 29/890.035
5,590,538 A * 1/1997 Hsu ..... F25B 9/10 62/51.1

* cited by examiner

*Primary Examiner* — Steve S Tanenbaum
(74) *Attorney, Agent, or Firm* — Hodgson Russ LLP

(57) ABSTRACT

A miniature Joule-Thomson cryocooler operating at liquid helium temperatures includes an integral structure formed by welding at least three base plates sequentially superposed, an outermost base plate in the at least three base plates is configured as a cover plate and configured to seal the rest of the at least three base plates, the rest of the at least three base plates is configured as a first-stage cooling circulator, a second-stage cooling circulator and a third-stage cooling circulator respectively, the first-stage cooling circulator, the second-stage cooling circulator and the third-stage cooling circulator have a first-stage working fluid, a second-stage working fluid and a third-stage working fluid respectively, the first-stage cooling circulator is configured to precool the second-stage working fluid and the third-stage working fluid through the first-stage working fluid, and the second-stage cooling circulator is configured to precool the third-stage working fluid through the second-stage working fluid.

8 Claims, 5 Drawing Sheets

MINIATURE JOULE-THOMSON CRYOCOOLER OPERATING AT LIQUID HELIUM TEMPERATURES

CROSS-REFERENCE TO RELATED APPLICATIONS

This application claims the benefit of priority to Chinese patent Application Nos. 202011366136.6 and 202011366114.X, filed on Nov. 29, 2020, the entire contents of which are incorporated by reference herein.

FIELD

The present invention pertains to the field of cryogenic cooling technologies, and particularly relates to a miniature Joule-Thomson cryocooler operating at liquid helium temperatures.

BACKGROUND

Many electronic devices have higher sensitivity when working in a cryogenic environment, such as infrared detection devices for aerospace, low noise amplifiers in radio telescopes, filters in mobile communication systems, or the like. Furthermore, a superconductor electronic device may only work normally in a cryogenic environment. With a development of a micro-electromechanical system (MEMS), a size of the electronic device is increasingly smaller, and a required cooling capacity is also small. An existing cryocooler has a size and a cooling capacity which do not meet requirements of the electronic device, and there exists an urgent need for a cryocooler matched therewith. A miniature Joule-Thomson cryocooler has advantages of no moving component, no vibration, no electromagnetic interference, easy miniaturization, or the like, and thus is favored in the aspect of cooling the electronic device. The miniature Joule-Thomson cryocooler may be implemented using an MEMS processing technology, but a current research is mainly focused on a temperature range higher than a liquid hydrogen temperature range (Cao H S, ter Crake H J M, Progress in and Outlook for Cryogenic Microcooling, Physical Review Applied, 2020, 14, 044044), and there is not found an experimental research of a miniature Joule-Thomson cryocooler operating at liquid helium temperatures based on the MEMS technology.

The miniature Joule-Thomson cryocooler operating at liquid helium temperatures is difficult to implement mainly due to a too low maximum Joule-Thomson transition temperature of helium, which is only 45 K. Since only neon and hydrogen are working fluids which may provide precooling temperatures below 45 K by a Joule-Thomson cooling operation, and have maximum Joule-Thomson transition temperatures of 250 K and 205 K, one more precooling stage is required by the Joule-Thomson cooling operation by the neon and the hydrogen, and therefore, at least two precooling stages are required if a liquid helium temperature is realized from a room temperature by the Joule-Thomson cooling operation. More working fluids may realize a cooling temperature below 205 K using a Joule-Thomson operation, such as nitrogen, oxygen, argon, carbon monoxide, or the like, maximum Joule-Thomson transition temperatures of these working fluids are far higher than the room temperature, and a cooling effect may be achieved using the Joule-Thomson operation without a precooling operation. For convenience of a later discussion, the working fluid which may achieve the Joule-Thomson cooling effect without the precooling operation is referred to as a first-stage working fluid herein, the neon and the hydrogen are referred to as a second-stage working fluid herein, and the helium is referred to as a third-stage working fluid herein.

SUMMARY

An object of the present invention is to provide a miniature Joule-Thomson cryocooler operating at liquid helium temperatures which overcomes the defects of the prior art.

The present invention provides a miniature Joule-Thomson cryocooler operating at liquid helium temperatures including an integral structure formed by welding at least three base plates sequentially superposed, an outermost base plate in the at least three base plates is configured as a cover plate and configured to seal the rest of the at least three base plates, the rest of the at least three base plates is configured as a first-stage cooling circulator, a second-stage cooling circulator and a third-stage cooling circulator respectively, the first-stage cooling circulator, the second-stage cooling circulator and the third-stage cooling circulator have a first-stage working fluid, a second-stage working fluid and a third-stage working fluid respectively, the first-stage cooling circulator is configured to precool the second-stage working fluid and the third-stage working fluid through the first-stage working fluid, and the second-stage cooling circulator is configured to precool the third-stage working fluid through the second-stage working fluid.

DETAILED DESCRIPTION

Figure 1:
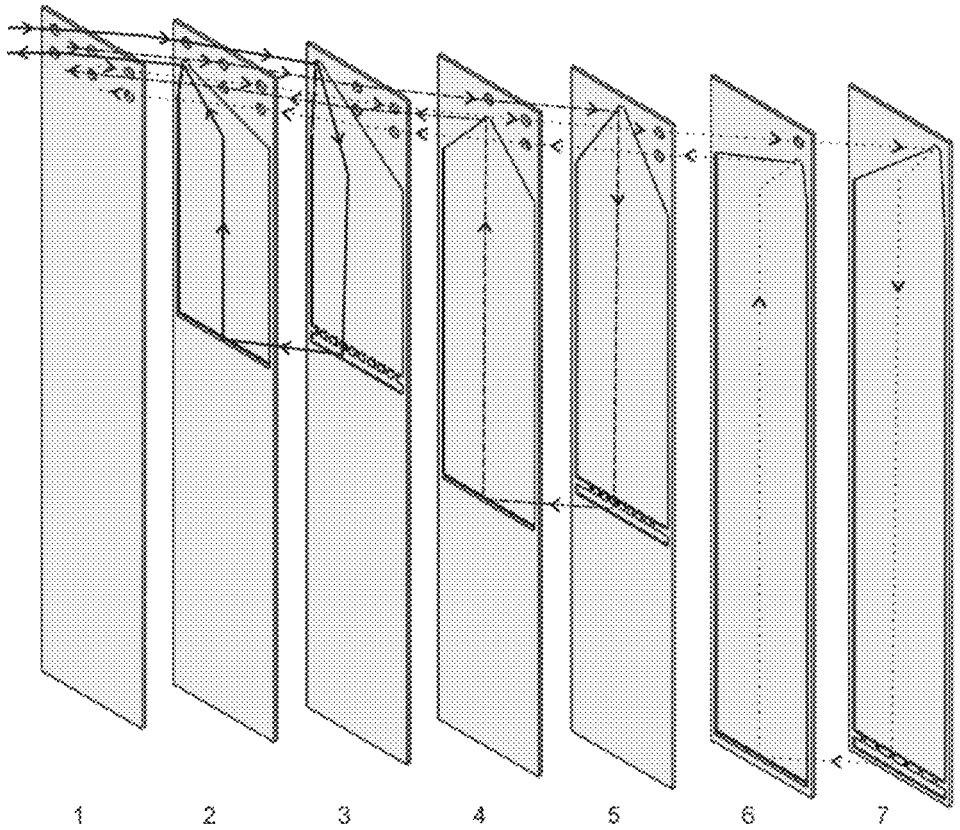
FIG. 1 is a schematic exploded view of a miniature Joule-Thomson cryocooler operating at liquid helium temperatures according to the present invention.

In order to make objects, technical solutions and advantages of the present invention more apparent, the present invention will be described in further detail with reference to the following drawings and embodiments. It should be understood that the specific embodiments described herein are merely for explaining the present invention and are not intended to limit the protection scope of the present invention.

In order to better understand the present invention, an application example of a miniature Joule-Thomson cryocooler operating at liquid helium temperatures according to the present invention will be described below in detail. The miniature Joule-Thomson cryocooler operating at liquid helium temperatures according to the present invention has a compact structure, and has advantages that large-scale production is facilitated, a cost is low, precision is high, and a repeatability is high, thus effectively improving a yield.

The miniature Joule-Thomson cryocooler operating at liquid helium temperatures according to an embodiment of the present invention, includes an integral structure formed by welding at least three base plates sequentially superposed, an outermost base plate in the at least three base plates is configured as a cover plate and configured to seal the rest of the at least three base plates, the rest of the at least three base plates is configured as a first-stage cooling circulator, a second-stage cooling circulator and a third-stage cooling circulator respectively, the first-stage cooling circulator, the second-stage cooling circulator and the third-stage cooling circulator have a first-stage working fluid, a second-stage working fluid and a third-stage working fluid respectively, the first-stage cooling circulator is configured to precool the second-stage working fluid and the third-stage working fluid through the first-stage working fluid, and the second-stage cooling circulator is configured to precool the third-stage working fluid through the second-stage working fluid.

In the embodiment of the present invention, in the miniature Joule-Thomson cryocooler operating at liquid helium temperatures, the integral structure is formed by welding seven base plates sequentially superposed; in the seven base plates, a first base plate serves as the cover plate, a second base plate and a third base plate form the first-stage cooling circulator, a fourth base plate and a fifth base plate form the second-stage cooling circulator, and a sixth base plate and a seventh base plate form the third-stage cooling circulator; a top end of the first base plate is provided with six through holes serving as a first-stage working fluid inlet, a second-stage working fluid inlet, a third-stage working fluid inlet, a first-stage working fluid outlet, a second-stage working fluid outlet and a third-stage working fluid outlet respectively; a top end of the second base plate is provided with five through holes serving as a first-stage working fluid inlet, a second-stage working fluid inlet, a third-stage working fluid inlet, a second-stage working fluid outlet and a third-stage working fluid outlet respectively; a top end of the third base plate is provided with four through holes serving as a second-stage working fluid inlet, a third-stage working fluid inlet, a second-stage working fluid outlet and a third-stage working fluid outlet respectively; a top end of the fourth base plate is provided with three through holes serving as a second-stage working fluid inlet, a third-stage working fluid inlet and a third-stage working fluid outlet respectively; a top end of the fifth base plate is provided with two through holes serving as a third-stage working fluid inlet and a third-stage working fluid outlet respectively; a top end of the sixth base plate is provided with one through hole serving as a third-stage working fluid inlet; the working fluid outlets and the working fluid inlets of the same type are arranged at same positions on the corresponding base plates; each of the third base plate, the fifth base plate and the seventh base plate is provided with a high-pressure side passage, a throttle valve and a buffer chamber in sequential communication, and an inlet end of each high-pressure side passage is in communication with the working fluid inlet of a corresponding stage; each of the second base plate, the fourth base plate and the sixth base plate is provided with a low-pressure side passage, and each low-pressure side passage has an inlet end in communication with the buffer chamber of a corresponding stage, and an outlet end in communication with the working fluid outlet of a corresponding stage; and the low-pressure side passages on the second base plate and the fourth base plate have functions of a heat exchanger, a precooler and an evaporator, and the low-pressure side passage on the sixth base plate has functions of a heat exchanger and an evaporator.

In the embodiment of the present invention, the first-stage cooling circulator and the second-stage cooling circulator are located between the first base plate and the third-stage cooling circulator, and the first-stage cooling circulator and the second-stage cooling circulator have interchangeable positions.

In the embodiment of the present invention, each buffer chamber has a width slightly greater than a width of a strip-shaped through hole in a corresponding base plate.

In the embodiment of the present invention, each of the first base plate, the second base plate and the third base plate is provided with a through hole serving as an additional first-stage working fluid inlet; the second base plate is further provided with an additional first-stage low-pressure side passage, and the additional first-stage low-pressure side passage has an outlet end in communication with the inlet end of the low-pressure side passage on the second base plate; the third base plate is further provided with an additional first-stage high-pressure side passage, an additional first-stage throttle valve and an additional first-stage buffer chamber in communication, the additional first-stage high-pressure side passage has a top end in communication with each additional first-stage working fluid inlet through an upward extending passage, and the additional first-stage buffer chamber is in communication with an inlet end of the additional first-stage low-pressure side passage on the second base plate.

In the embodiment of the present invention, each of the first base plate, the fourth base plate and the fifth base plate is provided with a through hole serving as an additional second-stage working fluid inlet; the fourth base plate is further provided with an additional second-stage low-pressure side passage, and the additional second-stage low-pressure side passage has an outlet end in communication with the inlet end of the low-pressure side passage on the fourth base plate; the fifth base plate is further provided with an additional second-stage high-pressure side passage, an additional second-stage throttle valve and an additional second-stage buffer chamber in communication, the additional second-stage high-pressure side passage has a top end in communication with each additional second-stage working fluid inlet through an upward extending passage, and the additional second-stage buffer chamber is in communication with an inlet end of the additional second-stage low-pressure side passage on the fourth base plate.

In the embodiment of the present invention, in the miniature Joule-Thomson cryocooler operating at liquid helium temperatures, the integral structure is formed by welding five base plates sequentially superposed; in the five base plates, a first base plate serves as the cover plate, a second base plate and a third base plate form the first-stage cooling circulator and the second-stage cooling circulator, and a fourth base plate and a fifth base plate form the third-stage cooling circulator; a top end of the first base plate is provided with six through holes serving as a first-stage working fluid inlet, a second-stage working fluid inlet, a third-stage working fluid inlet, a first-stage working fluid outlet, a second-stage working fluid outlet and a third-stage working fluid outlet respectively; a top end of the second base plate is provided with three through holes serving as a first-stage working fluid inlet, a third-stage working fluid inlet and a third-stage working fluid outlet respectively; a top end of the third base plate is provided with two through holes serving as a third-stage working fluid inlet and a third-stage working fluid outlet respectively; a top end of the fourth base plate is provided with one through hole serving as a third-stage working fluid inlet; the working fluid outlets and the working fluid inlets of the same type are arranged at same positions on the corresponding base plates; the third base plate is provided with a first-stage high-pressure side passage, a first-stage throttle valve and a first-stage buffer chamber in sequential communication, as well as a second-stage high-pressure side passage, a second-stage throttle valve and a second-stage buffer chamber in sequential communication, and the first-stage high-pressure side passage is not in communication with the second-stage high-pressure side passage; top ends of the first-stage high-pressure side passage and the second-stage high-pressure side passage are in communication with the first-stage working fluid inlet and the second-stage working fluid inlet respectively; the first-stage high-pressure side passage has at least two side walls arranged opposite to at least two side walls of the second-stage high-pressure side passage, and a second-stage flow deflector configured to adjust a flow direction of the second-stage working fluid in the second-stage high-pressure side passage is provided in the second-stage high-pressure side passage; the second base plate is provided with a first-stage low-pressure side passage and a second-stage low-pressure side passage not in communication, inlet ends of the first-stage low-pressure side passage and the second-stage low-pressure side passage are in communication with the first-stage working fluid outlet and the second-stage working fluid outlet respectively, and outlet ends of the first-stage low-pressure side passage and the second-stage low-pressure side passage are in communication with the first-stage buffer chamber and the second-stage buffer chamber respectively; the first-stage low-pressure side passage has at least two side walls arranged opposite to at least two side walls of the second-stage low-pressure side passage; a first-stage flow deflector configured to adjust a flow direction of the first-stage working fluid in the first-stage low-pressure side passage is provided in the first-stage low-pressure side passage and close to the inlet end thereof; the first-stage low-pressure side passage and the second-stage low-pressure side passage have functions of a heat exchanger, a precooler and an evaporator; the fifth base plate is provided with a third-stage high-pressure side passage, a third-stage throttle valve and a third-stage buffer chamber in sequential communication, and the third-stage high-pressure side passage has an inlet end in communication with the third-stage working fluid inlet; the fourth base plate is provided with a third-stage low-pressure side passage, and the third-stage low-pressure side passage has an inlet end and an outlet end in communication with the third-stage buffer chamber and the third-stage working fluid outlet respectively; and the third-stage low-pressure side passage has functions of a heat exchanger and an evaporator.

In the embodiment of the present invention, the first-stage low-pressure side passage and the second-stage low-pressure side passage both have a quasi-L-shaped cross section, and a side wall of a vertical segment of the second-stage low-pressure side passage is recessed to form a space for accommodating an end portion of a horizontal segment of the first-stage low-pressure side passage.

In the embodiment of the present invention, the inlet end of the first-stage low-pressure side passage is arranged at a junction of the horizontal segment and a vertical segment of the first-stage low-pressure side passage, and the first-stage flow deflector is located in the horizontal segment of the first-stage low-pressure side passage.

In the embodiment of the present invention, the first-stage high-pressure side passage has a quasi-rectangular cross section, the second-stage high-pressure side passage has a quasi-L-shaped cross section, and the first-stage high-pressure side passage is located in a region enclosed by a vertical segment and a horizontal segment of the second-stage high-pressure side passage; and the second-stage flow deflector is horizontally arranged in the horizontal segment of the second-stage high-pressure side passage.

In the embodiment of the present invention, in the miniature Joule-Thomson cryocooler operating at liquid helium temperatures, the integral structure is formed by welding five base plates sequentially superposed; in the five base plates, a first base plate serves as the cover plate, a second base plate and a third base plate form the first-stage cooling circulator, and a fourth base plate and a fifth base plate form the second-stage cooling circulator and the third-stage cooling circulator; a top end of the first base plate is provided with six through holes serving as a first-stage working fluid inlet, a second-stage working fluid inlet, a third-stage working fluid inlet, a first-stage working fluid outlet, a second-stage working fluid outlet and a third-stage working fluid outlet respectively; a top end of the second base plate is provided with five through holes serving as a first-stage working fluid inlet, a second-stage working fluid inlet, a third-stage working fluid inlet, a second-stage working fluid outlet and a third-stage working fluid outlet respectively; a top end of the third base plate is provided with four through holes serving as a second-stage working fluid inlet, a third-stage working fluid inlet, a second-stage working fluid outlet and a third-stage working fluid outlet respectively; a top end of the fourth base plate is provided with two through holes serving as a second-stage working fluid inlet and a third-stage working fluid inlet respectively; the working fluid outlets and the working fluid inlets of the same type are arranged at same positions on the corresponding base plates; the third base plate is provided with a first-stage high-pressure side passage, a first-stage throttle valve and a first-stage buffer chamber in sequential communication, and the first-stage high-pressure side passage has an inlet end in communication with the first-stage working fluid inlet; the second base plate is provided with a first-stage low-pressure side passage, and the first-stage low-pressure side passage has an inlet end and an outlet end in communication with the first-stage buffer chamber and the first-stage working fluid outlet respectively; the first-stage low-pressure side passage has functions of a heat exchanger, a precooler and an evaporator; the fifth base plate is provided with a second-stage high-pressure side passage, a second-stage throttle valve and a second-stage buffer chamber in sequential communication, as well as a third-stage high-pressure side passage, a third-stage throttle valve and a third-stage buffer chamber in sequential communication, and the second-stage high-pressure side passage is not in communication with the third-stage high-pressure side passage; top ends of the second-stage high-pressure side passage and the third-stage high-pressure side passage are in communication with the second-stage working fluid inlet and the third-stage working fluid inlet respectively; the second-stage high-pressure side passage has at least two side walls arranged opposite to at least two side walls of the third-stage high-pressure side passage, and a third-stage flow deflector configured to adjust a flow direction of the third-stage working fluid in the third-stage high-pressure side passage is provided in the third-stage high-pressure side passage; the fourth base plate is provided with a second-stage low-pressure side passage and a third-stage low-pressure side passage not in communication, outlet ends of the second-stage low-pressure side passage and the third-stage low-pressure side passage are in communication with the second-stage working fluid outlet and the third-stage working fluid outlet respectively, and inlet ends of the second-stage low-pressure side passage and the third-stage low-pressure side passage are in communication with the second-stage buffer chamber and the third-stage buffer chamber respectively; the second-stage low-pressure side passage has at least two side walls arranged opposite to at least two side walls of the third-stage low-pressure side passage; a second-stage flow deflector configured to adjust a flow direction of the second-stage working fluid in the second-stage low-pressure side passage is provided in the second-stage low-pressure side passage and close to the inlet end thereof; and the second-stage low-pressure side passage and the third-stage low-pressure side passage have functions of a heat exchanger and an evaporator.

In the embodiment of the present invention, the second-stage low-pressure side passage and the third-stage low-pressure side passage both have a quasi-L-shaped cross section, and a side wall of a vertical segment of the third-stage low-pressure side passage is recessed to form a space for accommodating an end portion of a horizontal segment of the second-stage low-pressure side passage.

In the embodiment of the present invention, the inlet end of the second-stage low-pressure side passage is arranged at a junction of the horizontal segment and a vertical segment of the second-stage low-pressure side passage, and the second-stage flow deflector is located in the horizontal segment of the second-stage low-pressure side passage.

In the embodiment of the present invention, the second-stage high-pressure side passage has a quasi-rectangular cross section, the third-stage high-pressure side passage has a quasi-L-shaped cross section, and the second-stage high-pressure side passage is located in a region enclosed by a vertical segment and a horizontal segment of the third-stage high-pressure side passage; and the third-stage flow deflector is horizontally arranged in the horizontal segment of the third-stage high-pressure side passage.

In the embodiment of the present invention, in the miniature Joule-Thomson cryocooler operating at liquid helium temperatures, the integral structure is formed by welding three base plates sequentially superposed; in the three base plates, a first base plate serves as the cover plate, and a second base plate and a third base plate form the first-stage cooling circulator, the second-stage cooling circulator and the third-stage cooling circulator; a top end of the first base plate is provided with six through holes serving as a first-stage working fluid inlet, a second-stage working fluid inlet, a third-stage working fluid inlet, a first-stage working fluid outlet, a second-stage working fluid outlet and a third-stage working fluid outlet respectively; a top end of the second base plate is provided with three through holes serving as a first-stage working fluid inlet, a second-stage working fluid inlet and a third-stage working fluid inlet respectively; the working fluid outlets and the working fluid inlets of the same type are arranged at same positions on the corresponding base plates; the third base plate is provided with a first-stage high-pressure side passage, a first-stage throttle valve and a first-stage buffer chamber in sequential communication, a second-stage high-pressure side passage, a second-stage throttle valve and a second-stage buffer chamber in sequential communication, as well as a third-stage high-pressure side passage, a third-stage throttle valve and a third-stage buffer chamber in sequential communication, and the high-pressure side passages of all stages are not in communication with each other; the high-pressure side passage of each stage has an inlet end in communication with a corresponding working fluid inlet; the first-stage high-pressure side passage has at least two side walls arranged opposite to at least two side walls of the second-stage high-pressure side passage, the second-stage high-pressure side passage has at least two side walls arranged opposite to at least two side walls of the third-stage high-pressure side passage, and high-pressure side flow deflectors are provided in the second-stage high-pressure side passage and the third-stage high-pressure side passage respectively and configured to adjust flow directions of the working fluids in the respective high-pressure side passages; the second base plate is provided with a first-stage low-pressure side passage, a second-stage low-pressure side passage and a third-stage low-pressure side passage not in communication; the low-pressure side passage of each stage has an outlet end in communication with a corresponding working fluid outlet, and an inlet end in communication with a corresponding buffer chamber; the first-stage low-pressure side passage has at least two side walls arranged opposite to at least two side walls of the second-stage low-pressure side passage, and the second-stage low-pressure side passage has at least two side walls arranged opposite to at least two side walls of the third-stage low-pressure side passage; low-pressure side flow deflectors are provided in the first-stage low-pressure side passage and the second-stage low-pressure side passage and close to the inlet ends thereof respectively and configured to adjust flow directions of the working fluids in the respective low-pressure side passages; and the first-stage low-pressure side passage and the second-stage low-pressure side passage have functions of a heat exchanger, a precooler and an evaporator, and the third-stage low-pressure side passage has functions of a heat exchanger and an evaporator.

In the embodiment of the present invention, the low-pressure side passage of each stage has a quasi-L-shaped cross section; a side wall of a vertical segment of the second-stage low-pressure side passage is recessed to form a space for accommodating an end portion of a horizontal segment of the first-stage low-pressure side passage; a bottom end of the second-stage low-pressure side passage extends in a width direction of the second base plate to form a protruding portion, and the protruding portion extends into a recess of a side wall of a vertical segment of the third-stage low-pressure side passage; each low-pressure side flow deflector is located in a horizontal segment of the corresponding low-pressure side passage; the first-stage high-pressure side passage has a quasi-rectangular cross section, and the second-stage high-pressure side passage and the third-stage high-pressure side passage have a quasi-L-shaped cross section; the first-stage high-pressure side passage is located in a region enclosed by a vertical segment and a horizontal segment of the second-stage high-pressure side passage, and the second-stage high-pressure side passage is located in a region enclosed by a vertical segment and a horizontal segment of the third-stage high-pressure side passage; and the high-pressure side flow deflector of each stage is horizontally arranged in the horizontal segment of the corresponding high-pressure side passage.

In the embodiment of the present invention, in the cooling circulator of each stage, when the low-pressure side passage is located above the high-pressure side passage, the buffer chamber is in communication with the inlet end of the low-pressure side passage through a strip-shaped through hole formed in a bottom end of the low-pressure side passage; when the low-pressure side passage is located below the high-pressure side passage, a through hole right opposite to the inlet end of the low-pressure side passage is formed in the buffer chamber, and the low-pressure side passage completely covers a region where the buffer chamber is located.

In the embodiment of the present invention, the first-stage working fluid is a working fluid capable of achieving a Joule-Thomson cooling effect without a precooling operation; the second-stage working fluid is neon or hydrogen; and the third-stage working fluid is helium.

In the embodiment of the present invention, a fin structure is provided in each low-pressure side passage, each high-pressure side passage and each buffer chamber.

In the embodiment of the present invention, a cross section of the fin structure has a shape of a rectangle, a circle, an ellipse, a diamond or a hydrofoil, and a size between several micrometers and tens of micrometers.

The present invention provides a miniature Joule-Thomson cryocooler capable of realizing a cooling temperature within a liquid helium temperature range. This structure is characterized in that 1) the low-pressure side passages of the first-stage working fluid, the second-stage working fluid and the third-stage working fluid and the evaporator have a same passage depth and may be implemented using a same processing method, which simplifies a processing technology of the cryocooler, and a gas-liquid two-phase enhanced heat exchange in the evaporator may be realized by different fin structure matrices; 2) the low-pressure side passage and the high-pressure side passage of the first-stage working fluid not only may realize a heat exchange between cold and hot fluids of the first-stage working fluid, but also have the function of precooling the second-stage working fluid and the third-stage working fluid; 3) similarly, the low-pressure side passage and the high-pressure side passage of the second-stage working fluid not only may realize a heat exchange between cold and hot fluids of the second-stage working fluid, but also have the function of precooling the third-stage working fluid; 4) the third-stage working fluid is precooled by the second-stage working fluid by integrating distribution and centralization, such that passages (such as a first-stage working fluid passage and a second-stage working fluid passage in FIG. 5, a second-stage working fluid passage and a third-stage working fluid passage in FIG. 6, as well as a first-stage working fluid passage, a second-stage working fluid passage and a third-stage working fluid passage in FIG. 7) of the working fluids of plural stages are arranged on the same base plate, which also simplifies the processing technology of the cryocooler, thereby reducing a processing risk and improving the yield; 5) the low-pressure side passages of the first-stage working fluid, the second-stage working fluid and the third-stage working fluid have functions of an evaporator, which further simplifies the processing technology of the cryocooler, thereby further reducing the processing risk and improving the yield.

On the whole, in the miniature Joule-Thomson cryocooler according to the present invention, the passages of the working fluids of plural stages are arranged on the same base plate, such that the cryocooler has a more compact structure, thus saving a processing cost. Furthermore, the passage defined in each base plate may be implemented using a micro-processing technology, such that industrial mass production is easy to realize, a processing size range is greater, and the precision is higher.

In addition, the flow heat exchanger, the precooler and the evaporator are integrated in the miniature Joule-Thomson cryocooler according to the present invention, such that the cryocooler has a more compact structure, thus further saving the processing cost.

First Embodiment

Figure 2:
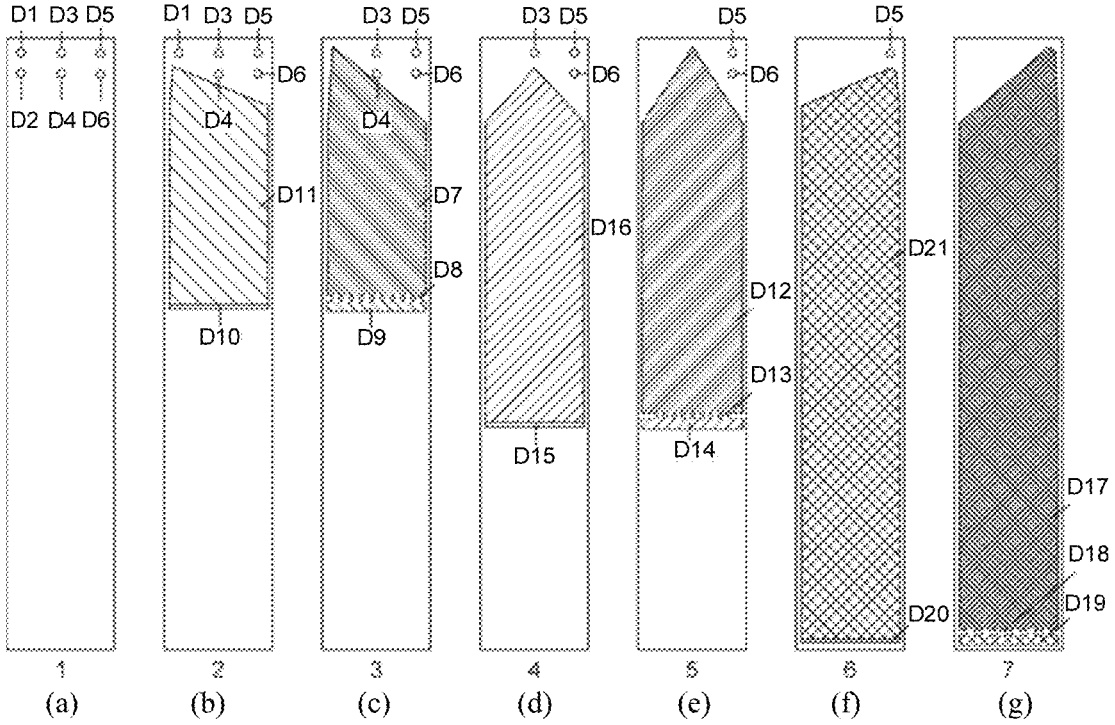
FIGS. 2(*a*) to 2(*g*) are schematic views of internal structures of base plates 1-7 in a miniature Joule-Thomson cryocooler D operating at liquid helium temperatures according to a first embodiment of the present invention respectively.

Referring to FIGS. 1 and 2, a miniature Joule-Thomson cryocooler D operating at liquid helium temperatures according to a first embodiment of the present invention has an integral structure formed by welding seven base plates sequentially superposed 1-7.

The base plate 1 serves as a cover plate to seal the rest of the seven base plates, the base plates 2, 3 form a first-stage cooling circulator, the base plates 4, 5 form a second-stage cooling circulator, and the base plates 6, 7 form a third-stage cooling circulator.

A top end of the base plate 1 is provided with six through holes serving as a first-stage working fluid inlet D1, a second-stage working fluid inlet D3, a third-stage working fluid inlet D5, a first-stage working fluid outlet D2, a second-stage working fluid outlet D4 and a third-stage working fluid outlet D6 respectively.

A top end of the base plate 2 is provided with five through holes serving as a first-stage working fluid inlet D1, a second-stage working fluid inlet D3, a third-stage working fluid inlet D5, a second-stage working fluid outlet D4 and a third-stage working fluid outlet D6 respectively, the base plate 2 is further provided with a first-stage low-pressure side passage D11 and a first-stage strip-shaped through hole D10 which is in communication with an inlet end of the first-stage low-pressure side passage D11 and defined in a width direction of the base plate 2, an outlet end of the first-stage low-pressure side passage D11 is in communication with the first-stage working fluid outlet D2 on the base plate 1, and a top end of the first-stage low-pressure side passage D11 should avoid corresponding regions of the base plate 1 provided with the first-stage working fluid inlet D1, the second-stage working fluid inlet D3, the third-stage working fluid inlet D5, the second-stage working fluid outlet D4 and the third-stage working fluid outlet D6.

A top end of the base plate 3 is provided with four through holes serving as a second-stage working fluid inlet D3, a third-stage working fluid inlet D5, a second-stage working fluid outlet D4 and a third-stage working fluid outlet D6 respectively; the base plate 3 is also provided with a first-stage high-pressure side passage D7, a first-stage throttle valve D8 and a first-stage buffer chamber D9 in sequential communication, an inlet end of the first-stage high-pressure side passage D7 is simultaneously in communication with the first-stage working fluid inlets D1 on the base plate 1 and the base plate 2, and a top end of the first-stage high-pressure side passage D7 should avoid corresponding regions of the base plate 1 provided with the second-stage working fluid inlet D3, the third-stage working fluid inlet D5, the second-stage working fluid outlet D4 and the third-stage working fluid outlet D6; the first-stage buffer chamber D9 is in communication with the first-stage strip-shaped through hole D10 on the base plate 2, and a region where the first-stage buffer chamber D9 is located should completely cover a region where the first-stage strip-shaped through hole D10 is located, such that a first-stage working fluid may smoothly flow into the first-stage low-pressure side passage D11 without influencing circulation of other working fluids; distances from bottom ends of the first-stage working fluid buffer chamber D9 and the strip-shaped through hole D10 to a bottom end of the base plate determine heat exchange areas of the high-pressure and low-pressure side passages of the first-stage working fluid, and are required to be determined according to mass flow of the first-stage working fluid.

A top end of the base plate 4 is provided with three through holes serving as a second-stage working fluid inlet D3, a third-stage working fluid inlet D5 and a third-stage working fluid outlet D6 respectively, the base plate 4 is further provided with a second-stage low-pressure side passage D16 and a second-stage strip-shaped through hole D15 which is in communication with an inlet end of the second-stage low-pressure side passage D16 and defined in a width direction of the base plate 4, an outlet end of the second-stage low-pressure side passage D16 is simultaneously in communication with the second-stage working fluid outlets D4 on the base plates 1, 2, 3, and a top end of the second-stage low-pressure side passage D16 should avoid corresponding regions of the base plate 1 provided with the first-stage working fluid inlet D1, the second-stage working fluid inlet D3, the third-stage working fluid inlet D5, the first-stage working fluid outlet D2 and the third-stage working fluid outlet D6.

A top end of the base plate 5 is provided with two through holes serving as a third-stage working fluid inlet D5 and a third-stage working fluid outlet D6 respectively; the base plate 5 is also provided with a second-stage high-pressure side passage D12, a second-stage throttle valve D13 and a second-stage buffer chamber D14 in sequential communication, an inlet end of the second-stage high-pressure side passage D12 is simultaneously in communication with the second-stage working fluid inlets D3 on the base plates 1, 2, 3, and a top end of the second-stage high-pressure side passage D12 should avoid corresponding regions of the base plate 1 provided with the first-stage working fluid inlet D1, the third-stage working fluid inlet D5, the first-stage working fluid outlet D2 and the third-stage working fluid outlet D6; the second-stage buffer chamber D14 is in communication with the second-stage strip-shaped through hole D15 on the base plate 4, and a region where the second-stage buffer chamber D14 is located should completely cover a region where the second-stage strip-shaped through hole D15 is located, such that a second-stage working fluid may smoothly flow into the second-stage low-pressure side passage D16 without influencing circulation of other working fluids; distances from bottom ends of the second-stage working fluid buffer chamber D14 and the strip-shaped through hole D15 to a bottom end of the base plate determine heat exchange areas of the high-pressure and low-pressure side passages of the second-stage working fluid, and are required to be determined according to mass flow of the second-stage working fluid.

A top end of the base plate 6 is provided with one through hole serving as a third-stage working fluid inlet D5, the base plate 6 is further provided with a third-stage low-pressure side passage D21 and a third-stage strip-shaped through hole D20 which is in communication with an inlet end of the third-stage low-pressure side passage D21 and defined in a width direction of the base plate 6, an outlet end of the third-stage low-pressure side passage D21 is simultaneously in communication with the third-stage working fluid outlets D6 on the base plates 1-5, two ends of the third-stage low-pressure side passage D21 should extend towards two ends of the base plate 6 as far as possible, and a top end of the third-stage low-pressure side passage D21 should avoid corresponding regions of the base plate 1 provided with the first-stage working fluid inlet D1, the second-stage working fluid inlet D3, the third-stage working fluid inlet D5, the first-stage working fluid outlet D2, the second-stage working fluid outlet D4 and the third-stage working fluid outlet D6.

The base plate 7 is provided with a third-stage high-pressure side passage D17, a third-stage throttle valve D18 and a third-stage buffer chamber D19 in sequential communication, an inlet end of the third-stage high-pressure side passage D17 is simultaneously in communication with the third-stage working fluid inlets D5 on the base plates 1-5, a top end of the third-stage high-pressure side passage D17 should avoid corresponding regions of the base plate 1 provided with the first-stage working fluid inlet D1, the second-stage working fluid inlet D3, the first-stage working fluid outlet D2 and the second-stage working fluid outlet D4, the third-stage buffer chamber D19 is in communication with the third-stage strip-shaped through hole D20 on the base plate 6, and a region where the third-stage buffer chamber D19 is located should completely cover a region where the third-stage strip-shaped through hole D20 is located, such that the third-stage working fluid may smoothly flow into the third-stage low-pressure side passage without influencing the circulation of other working fluids.

The corresponding working fluid inlet and the corresponding working fluid outlet are arranged at same positions on each base plate.

The low-pressure side passage and the high-pressure side passage of each stage have widths far greater than depths of respective passages, and selection of the width and the depth depends on a pressure of the working fluid borne by the passage and a requirement for a cooling capacity of the cryocooler. A fin structure is required to be provided in the high-pressure side passage of each stage, the low-pressure side passage of each stage and the buffer chamber of each stage, and configured to, on the one hand, control a stress distribution in the passage, such that the cryocooler may bear a higher pressure, and on the other hand, control the flow and heat exchange in the passage to improve a performance of the cryocooler; a cross section of the fin structure has a shape of a rectangle, a circle, an ellipse, a diamond, a hydrofoil, or the like, and a size between several micrometers and tens of micrometers; the corresponding high-pressure side passage and the corresponding low-pressure passage form a dividing wall type heat exchanger to play a role of heat recovery, and in addition, the low-pressure side passage of each stage has functions of a precooler and an evaporator.

The buffer chamber of each stage has a depth consistent with a depth of the corresponding high-pressure side passage, such that a processing operation is convenient; the buffer chamber of each stage has a width slightly greater than a width of the strip-shaped through hole on the corresponding base plate, such that the fluid in the buffer chamber may conveniently pass through the strip-shaped through hole of the corresponding base plate.

In order to reduce heat conduction loss from a hot end to a cold end, each base plate in the miniature Joule-Thomson cryocooler D operating at liquid helium temperatures is made of a material with a small heat conduction coefficient, such as glass, polymers, ceramics, or the like. Optionally, the passages on each of the base plates 1-7 may be implemented by means of chemical etching, electron beam micro-processing, ion beam micro-processing, laser micro-processing, and LIGA processing (i.e., photolithography, electroforming and injection molding). In the present embodiment, the chemical etching method is preferred for the processing operation (for specific process parameters of the chemical etching method, seeing Iliescu C, Tay F E H, Miao J M, Strategies in deep wet etching of Pyrex glass, Sensors and Actuators A Physical, 2007, 133, 395-400). Compared with other processing methods, the chemical etching method facilitates realization of industrial mass production, and compared with the LIGA technology, the chemical etching method has a greater processing size range and higher precision. After the passage is processed, the seven base plates may be welded using a welding technology (such as vacuum diffusion welding for bonding between glass and glass, and anodic welding for bonding between a silicon base plate and glass, the technologies being conventional processing technologies in the field) suitable for the selected material of the base plate.

The miniature Joule-Thomson cryocooler D operating at liquid helium temperatures according to the present embodiment has three stages of circulation passages:

The first-stage working fluid is a working fluid capable of achieving a Joule-Thomson cooling effect without a pre-cooling operation, and flows in the first-stage circulation passage, and a flow path thereof is as follows: the first-stage working fluid inlet D1→the first-stage high-pressure side passage D7→the first-stage throttle valve D8→the first-stage buffer chamber D9→the first-stage strip-shaped through hole D10→the first-stage low-pressure side passage D11→the first-stage working fluid outlet D2. The gas-phase first-stage working fluid in a high-pressure state flows into the first-stage high-pressure side passage D7 through the first-stage working fluid inlets D1 on the base plate 1 and the base plate 2 for a heat exchange, flows through the first-stage throttle valve D8 for Joule-Thomson expansion cooling, and then flows into the first-stage low-pressure side passage D11 through the first-stage buffer chamber D9 and the first-stage strip-shaped through hole D10 for a heat exchange with gas in the first-stage high-pressure side passage D7; in a stable state, the first-stage working fluid in the first-stage low-pressure side passage D11 has a gas phase and a liquid phase, the liquid phase absorbs heat to be gasified to achieve purposes of cooling and precooling the second-stage working fluid and the third-stage working fluid, and the gasified first-stage working fluid is discharged from the first-stage working fluid outlet D2 to complete one cycle.

The second-stage working fluid is neon or hydrogen, and flows in the second-stage circulation passage, and the flow path thereof is as follows: the second-stage working fluid inlet D3→the second-stage high-pressure side passage D12→the second-stage throttle valve D13→the second-stage buffer chamber D14→the second-stage strip-shaped through hole D15→the second-stage low-pressure side passage D16→the second-stage working fluid outlet D4. The gas-phase second-stage working fluid in a high-pressure state flows into the second-stage high-pressure side passage D12 through the second-stage working fluid inlets D3 on the base plates 1-4, and is precooled by cold energy generated by the first-stage working fluid in the second-stage high-pressure side passage D12, and after a temperature of the second-stage working fluid before flowing into the second-stage throttle valve D13 is lower than a transition temperature of the second-stage working fluid, the second-stage working fluid generates a cooling effect through throttle expansion, and then flows into the second-stage low-pressure side passage D16 through the second-stage buffer chamber D14 and the second-stage strip-shaped through hole D15 for a heat exchange with gas in the second-stage high-pressure side passage D12; in a stable state, the second-stage working fluid in the second-stage low-pressure side passage D16 has a gas phase and a liquid phase, the liquid phase absorbs heat to be gasified to achieve purposes of cooling and precooling the third-stage working fluid, and the gasified second-stage working fluid is discharged from the second-stage working fluid outlet D4 to complete one cycle.

The third-stage working fluid is helium, and flows in the third-stage circulation passage, and a flow path thereof is as follows: the third-stage working fluid inlet D5→the third-stage high-pressure side passage D17→the third-stage throttle valve D18→the third-stage buffer chamber D19→the third-stage strip-shaped through hole D20→the third-stage low-pressure side passage D21→the third-stage working fluid outlet D6. The gas-phase third-stage working fluid in a high-pressure state flows into the third-stage high-pressure side passage D17 through the third-stage working fluid inlets D5 on the base plates 1-6, and is precooled by cold energy generated by the first-stage working fluid and the second-stage working fluid in the third-stage high-pressure side passage D17, and after a temperature of the third-stage working fluid before flowing into the third-stage throttle valve D18 is lower than a transition temperature of the third-stage working fluid, the third-stage working fluid generates a cooling effect through throttle expansion, and then flows into the third-stage low-pressure side passage D21 through the third-stage buffer chamber D19 and the third-stage strip-shaped through hole D20 for a heat exchange with gas in the third-stage high-pressure side passage D17; in a stable state, the third-stage working fluid in the third-stage low-pressure side passage D21 has a gas phase and a liquid phase, the liquid phase absorbs heat to be gasified to achieve a cooling purpose, and the gasified third-stage working fluid is discharged from the third-stage working fluid outlet D6 to complete one cycle.

In summary, with this design, the low-pressure side passages on the base plates 2, 4 have triple functions of a heat exchanger, a precooler and an evaporator, and the low-pressure side passage on the base plate 6 has double functions of a heat exchanger and an evaporator, such that the cryocooler has a more compact structure.

Second Embodiment

Figure 3:
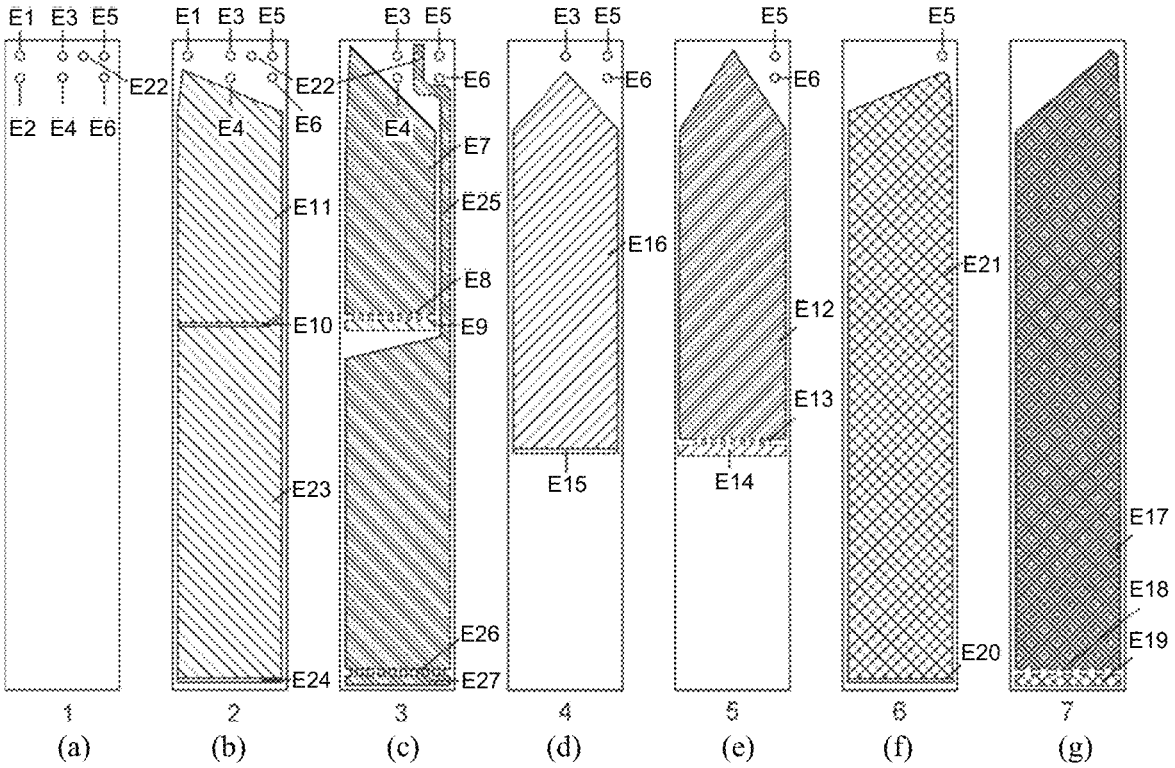
FIGS. 3(*a*) to 3(*g*) are schematic views of internal structures of base plates 1-7 in a miniature Joule-Thomson cryocooler E operating at liquid helium temperatures according to a second embodiment of the present invention respectively.

FIG. 3 is a schematic diagram of an internal structure of a miniature Joule-Thomson cryocooler E operating at liquid helium temperatures according to a second embodiment of the present invention, and the Joule-Thomson cryocooler E has an integral structure formed by welding seven base plates sequentially superposed 1-7.

The base plate 1 serves as a cover plate to seal the rest of the seven base plates, the base plates 2, 3 form a first-stage cooling circulator, the base plates 4, 5 form a second-stage cooling circulator, and the base plates 6, 7 form a third-stage cooling circulator.

A top end of the base plate 1 is provided with seven through holes serving as a first-stage working fluid inlet E1, a second-stage working fluid inlet E3, an additional first-stage working fluid inlet E22, a third-stage working fluid inlet E5, a first-stage working fluid outlet E2, a second-stage working fluid outlet E4 and a third-stage working fluid outlet E6 respectively.

A top end of the base plate 2 is provided with six through holes serving as a first-stage working fluid inlet E1, a second-stage working fluid inlet E3, an additional first-stage working fluid inlet E22, a third-stage working fluid inlet E5, a second-stage working fluid outlet E4 and a third-stage working fluid outlet E6 respectively, the base plate 2 is further provided with a first-stage low-pressure side passage E11, a first-stage strip-shaped through hole E10 which is in communication with an inlet end of the first-stage low-pressure side passage E11 and defined in a width direction of the base plate 2, an additional first-stage low-pressure side passage E23 and an additional first-stage strip-shaped through hole E24 which is in communication with an inlet end of the additional first-stage low-pressure side passage E23 and defined in the width direction of the base plate 2, and a bottom end of the additional first-stage strip-shaped through hole E24 abuts against a bottom end of the base plate 2; an outlet end of the first-stage low-pressure side passage E11 is in communication with the first-stage working fluid outlet E2 on the base plate 1, and a top end of the first-stage low-pressure side passage E11 should avoid corresponding regions of the base plate 1 provided with the first-stage working fluid inlet E1, the additional first-stage working fluid inlet E22, the second-stage working fluid inlet E3, the third-stage working fluid inlet E5, the second-stage working fluid outlet E4 and the third-stage working fluid outlet E6.

A top end of the base plate 3 is provided with four through holes serving as a second-stage working fluid inlet E3, a third-stage working fluid inlet E5, a second-stage working fluid outlet E4 and a third-stage working fluid outlet E6 respectively; the base plate 3 is also provided with a first-stage high-pressure side passage E7, a first-stage throttle valve E8 and a first-stage buffer chamber E9 in sequential communication, as well as an additional first-stage high-pressure side passage E25, an additional first-stage throttle valve E26 and an additional first-stage buffer chamber E27 abutting against a bottom end of the base plate 3, an inlet end of the first-stage high-pressure side passage E7 is simultaneously in communication with the first-stage working fluid inlets E1 on the base plates 1, 2, a top end of the first-stage high-pressure side passage E7 should avoid corresponding regions of the base plate 1 provided with the additional first-stage working fluid inlet E22, the second-stage working fluid inlet E3, the third-stage working fluid inlet E5, the second-stage working fluid outlet E4 and the third-stage working fluid outlet E6, and the first-stage buffer chamber E9 is in communication with the first-stage strip-shaped through hole E10 on the base plate 2; a top end of the additional first-stage high-pressure side passage E25 is simultaneously in communication with the additional first-stage working fluid inlets E22 on the base plates 1, 2, 3 through upwards extending passages, the additional first-stage buffer chamber E27 is in communication with the additional first-stage strip-shaped through hole E24 on the base plate 2, and the bottom end of the additional first-stage strip-shaped through hole E24 abuts against the bottom end of the base plate 3.

A top end of the base plate 4 is provided with three through holes serving as a second-stage working fluid inlet E3, a third-stage working fluid inlet E5 and a third-stage working fluid outlet E6 respectively, the base plate 4 is further provided with a second-stage low-pressure side passage E16 and a second-stage strip-shaped through hole E15 which is in communication with an inlet end of the second-stage low-pressure side passage E16 and defined in a width direction of the base plate 4, an outlet end of the second-stage low-pressure side passage E16 is simultaneously in communication with the second-stage working fluid outlets E4 on the base plates 1, 2, 3, and a top end of the second-stage low-pressure side passage E16 should avoid corresponding regions of the base plate 1 provided with the first-stage working fluid inlet E1, the additional first-stage working fluid inlet E22, the second-stage working fluid inlet E3, the third-stage working fluid inlet E5, the first-stage working fluid outlet E2 and the third-stage working fluid outlet E6.

A top end of the base plate 5 is provided with two through holes serving as a third-stage working fluid inlet E5 and a third-stage working fluid outlet E6 respectively; the base plate 5 is also provided with a second-stage high-pressure side passage E12, a second-stage throttle valve E13 and a second-stage buffer chamber E14 in sequential communication, an inlet end of the second-stage high-pressure side passage E12 is simultaneously in communication with the second-stage working fluid inlets E3 on the base plates 1, 2, 3, a top end of the second-stage high-pressure side passage E12 should avoid corresponding regions of the base plate 1 provided with the first-stage working fluid inlet E1, the additional first-stage working fluid inlet E22, the third-stage working fluid inlet E5, the first-stage working fluid outlet E2 and the third-stage working fluid outlet E6, and the second-stage buffer chamber E14 is in communication with the second-stage strip-shaped through hole E15 on the base plate 4. Distances from bottom ends of the second-stage working fluid buffer chamber E14 and the strip-shaped through hole E15 to bottom ends of the corresponding base plates determine heat exchange areas of the high-pressure and low-pressure side passages of the second-stage working fluid, and are required to be determined according to mass flow of the second-stage working fluid.

A top end of the base plate 6 is provided with one through hole serving as a third-stage working fluid inlet E5, the base plate 6 is further provided with a third-stage low-pressure side passage E21 and a third-stage strip-shaped through hole E20 which is in communication with an inlet end of the third-stage low-pressure side passage E21 and defined in a width direction of the base plate 6, an outlet end of the third-stage low-pressure side passage E21 is simultaneously in communication with the third-stage working fluid outlets E6 on the base plates 1-5, two ends of the third-stage low-pressure side passage E21 should extend towards two ends of the base plate 6 as far as possible, and a top end of the third-stage low-pressure side passage E21 should avoid corresponding regions of the base plate 1 provided with the first-stage working fluid inlet E1, the additional first-stage working fluid inlet E22, the second-stage working fluid inlet E3, the third-stage working fluid inlet E5, the first-stage working fluid outlet E2, the second-stage working fluid outlet E4 and the third-stage working fluid outlet E6.

The base plate 7 is provided with a third-stage high-pressure side passage E17, a third-stage throttle valve E18 and a third-stage buffer chamber E19 in sequential communication, an inlet end of the third-stage high-pressure side passage E17 is simultaneously in communication with the third-stage working fluid inlets E5 on the base plates 1-5, a top end of the third-stage high-pressure side passage E17 should avoid corresponding regions of the base plate 1 provided with the first-stage working fluid inlet E1, the additional first-stage working fluid inlet E22, the second-stage working fluid inlet E3, the first-stage working fluid outlet E2 and the second-stage working fluid outlet E4, and the third-stage buffer chamber E19 is in communication with the third-stage strip-shaped through hole E20 on the base plate 6; and bottom ends of the third-stage strip-shaped through hole E20 and the third-stage buffer chamber E19 abut against bottom ends of the base plates 6, 7 respectively.

The corresponding working fluid inlet and the corresponding working fluid outlet are arranged at same positions on each base plate.

For a specific implementation of each component in the miniature Joule-Thomson cryocooler E operating at liquid helium temperatures, reference is made to the miniature Joule-Thomson cryocooler D operating at liquid helium temperatures, which is not repeated herein.

The miniature Joule-Thomson cryocooler E operating at liquid helium temperatures according to the present embodiment has three stages of circulation passages, the second-stage working fluid and the third-stage working fluid flow in the second-stage circulation passage and the third-stage circulation passage respectively, and the flow paths are same as those of the second-stage working fluid and the third-stage working fluid in the miniature Joule-Thomson cryocooler D operating at liquid helium temperatures, which are not repeated herein.

In the miniature Joule-Thomson cryocooler E operating at liquid helium temperatures, the first-stage working fluid flows in the first-stage circulation passage, and the flow path thereof is as follows: the first-stage working fluid inlet E1→the high-pressure side passage E7→the first-stage throttle valve E8→the first-stage buffer chamber E9→the first-stage strip-shaped through hole E10→the first-stage low-pressure side passage E11→the first-stage working fluid outlet E2, and the flow path of the first-stage working fluid in the additional first-stage circulation passage is as follows: the additional first-stage working fluid inlet E22→the additional first-stage high-pressure side passage E25→the additional first-stage throttle valve E26→the additional first-stage buffer chamber E27→the additional first-stage strip-shaped through hole E24→the additional first-stage low-pressure side passage E23→the first-stage strip-shaped through hole E10→the first-stage low-pressure side passage E11→the first-stage working fluid outlet E2.

Compared with the miniature Joule-Thomson cryocooler D operating at liquid helium temperatures, in the miniature Joule-Thomson cryocooler E operating at liquid helium temperatures, flow of the first-stage working fluid may be increased in the cooling process through the additional first-stage working fluid additional passages which are additionally provided on the base plates 2, 3 respectively, thus shortening a cooling time. When the first-stage working fluid reaches a saturation temperature thereof, the mass flow of the first-stage working fluid in the first-stage working fluid additional passage is reduced to 0, such that there is no influence on reduction of temperatures of the second-stage working fluid and the third-stage working fluid to a lower temperature from a boiling temperature of the first-stage working fluid.

Preferably, the base plate provided with the low-pressure side passage in the third-stage cooling circulator is arranged on the outermost side to reduce a thermal resistance with a cooled device.

In other embodiments of the present invention, each of the base plates 1, 4, 5 is provided with a through hole serving as an additional second-stage working fluid inlet; the base plate 4 is further provided with an additional second-stage low-pressure side passage, and the additional second-stage low-pressure side passage has an outlet end in communication with an inlet end of the low-pressure side passage on the base plate 4; the base plate 5 is further provided with an additional second-stage high-pressure side passage, an additional second-stage throttle valve and an additional second-stage buffer chamber in communication, the additional second-stage high-pressure side passage has a top end in communication with each additional second-stage working fluid inlet through an upward extending passage, and the additional second-stage buffer chamber is in communication with an inlet end of the additional second-stage low-pressure side passage on the base plate 4.

Third Embodiment

Figure 4:
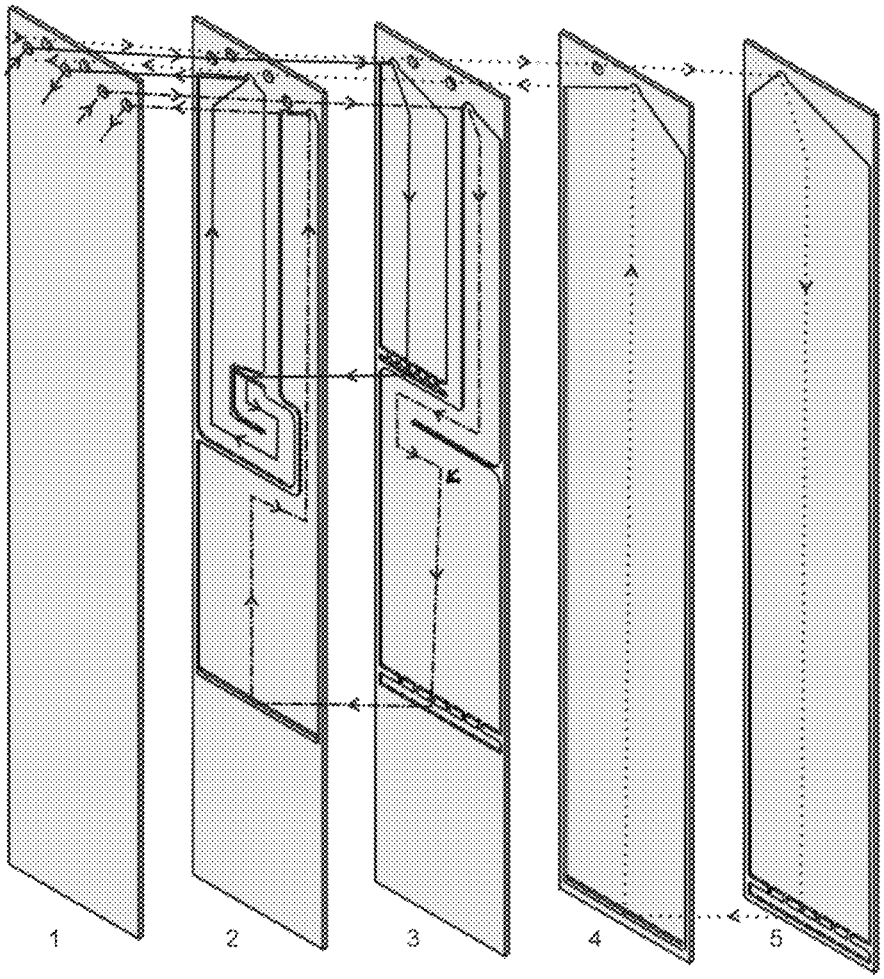
FIG. 4 is a schematic exploded view of a miniature Joule-Thomson cryocooler operating at liquid helium temperatures according to the present invention.
Figure 5:
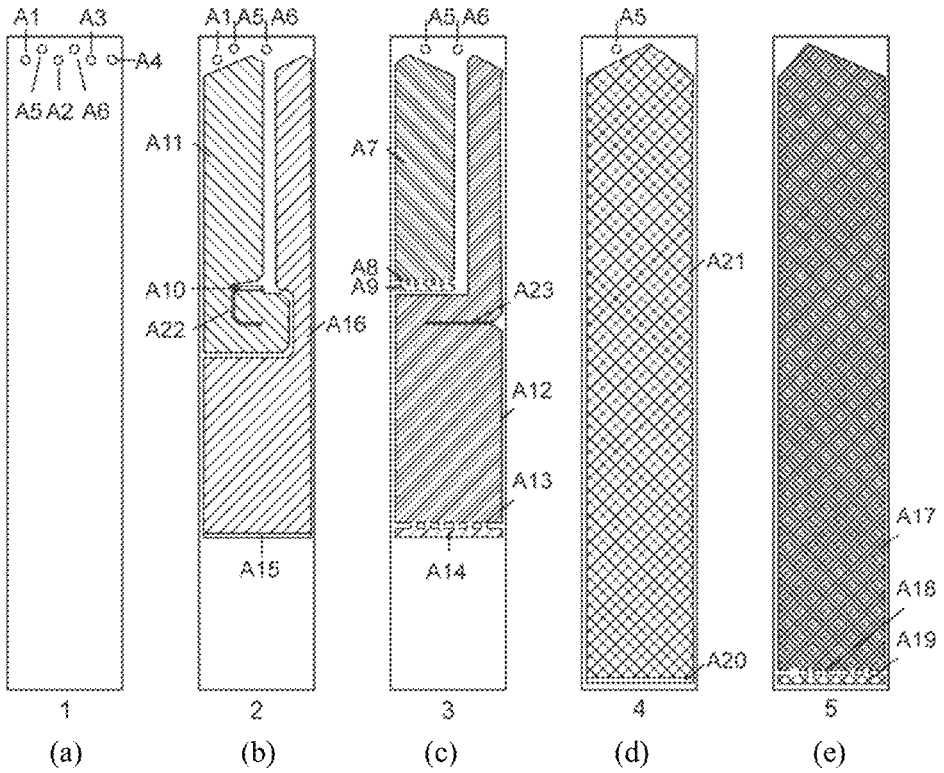
FIGS. 5(*a*) to 5(*e*) are schematic views of internal structures of base plates 1-5 in a miniature Joule-Thomson cryocooler A operating at liquid helium temperatures according to a third embodiment of the present invention.

Referring to FIGS. 4 and 5, a miniature Joule-Thomson cryocooler A operating at liquid helium temperatures according to a third embodiment of the present invention includes an integral structure formed by welding five base plates sequentially superposed 1-5.

The base plate 1 serves as a cover plate to seal the rest of the five base plates, the base plates 2, 3 form a first-stage cooling circulator and a second-stage cooling circulator, the base plates 4, 5 form a third-stage cooling circulator, and the first-stage cooling circulator is located between the base plate 1 and the third-stage cooling circulator.

A top end of the base plate 1 is provided with six through holes serving as a first-stage working fluid inlet A1, a second-stage working fluid inlet A3, a third-stage working fluid inlet A5, a first-stage working fluid outlet A2, a second-stage working fluid outlet A4 and a third-stage working fluid outlet A6 respectively.

A top end of the base plate 2 is provided with three through holes serving as a first-stage working fluid inlet A1, a third-stage working fluid inlet A5 and a third-stage working fluid outlet A6 respectively, the base plate 2 is further provided with a first-stage low-pressure side passage A11, a first-stage strip-shaped through hole A10 which is in communication with an inlet end of the first-stage low-pressure side passage A11 and defined in a width direction of the base plate 2, a second-stage low-pressure side passage A16 and a second-stage strip-shaped through hole A15 which is in communication with an inlet end of the second-stage low-pressure side passage A16 and defined in the width direction of the base plate 2, and the first-stage low-pressure side passage A11 is not in communication with the second-stage low-pressure side passage A16. Each of the first-stage low-pressure side passage A11 and the second-stage low-pressure side passage A16 has at least two oppositely arranged side surfaces; in the present embodiment, the first-stage low-pressure side passage A11 and the second-stage low-pressure side passage A16 are arranged opposite to each other and both have a quasi-L-shaped cross section, a side wall of a vertical segment of the second-stage low-pressure side passage A16 is recessed to form a space for accommodating an end portion of a horizontal segment of the first-stage low-pressure side passage A11, and a heat exchange area of a first-stage working fluid in the first-stage low-pressure side passage A11 and a second-stage working fluid in a second-stage high-pressure side passage A12 on the base plate 3 may be increased by the horizontal segment of the first-stage low-pressure side passage A11, so as to achieve a centralized precooling effect of the first-stage working fluid on the second-stage working fluid; the first-stage strip-shaped through hole A10 is defined at a junction of the horizontal segment and a vertical segment of the first-stage low-pressure side passage A11, i.e., the inlet end of the first-stage low-pressure side passage A11, and a flow deflector A22 connected with the first-stage strip-shaped through hole A10 is provided in the horizontal segment of the first-stage low-pressure side passage A11 and configured to adjust a flow direction of the first-stage working fluid in the first-stage low-pressure side passage A11, so as to prolong a length of a flow passage of the first-stage working fluid from the first-stage strip-shaped through hole A10 flowing through this region, strengthen a heat exchange between the first-stage working fluid in the first-stage low-pressure side passage A11 and the second-stage working fluid in the second-stage high-pressure side passage A12, and strengthen the centralized precooling effect of the first-stage working fluid on the second-stage working fluid; an outlet end of the first-stage low-pressure side passage A11 is in communication with the first-stage working fluid outlet A2 on the base plate 1, and a top end of the first-stage low-pressure side passage A11 should avoid corresponding regions of the base plate 1 provided with the first-stage working fluid inlet A1, the second-stage working fluid inlet A3, the third-stage working fluid inlet A5, the second-stage working fluid outlet A4 and the third-stage working fluid outlet A6; a distance from a bottom end of the second-stage strip-shaped through hole A15 on the base plate 2 to a bottom end of the base plate 2 determines the heat exchange areas of the high-pressure side passage and the low-pressure side passage of the second-stage working fluid, and is required to be determined according to mass flow of the second-stage working fluid; top ends of the first-stage low-pressure side passage A11 and the second-stage low-pressure side passage A16 on the base plate 2 should avoid corresponding regions of the base plate 1 provided with the first-stage working fluid inlet A1, the second-stage working fluid inlet A3, the third-stage working fluid inlet A5, the second-stage working fluid outlet A4 and the third-stage working fluid outlet A6.

A top end of the base plate 3 is provided with two through holes serving as a third-stage working fluid inlet A5 and a third-stage working fluid outlet A6 respectively, the base plate 3 is further provided with a first-stage high-pressure side passage A7, a first-stage throttle valve A8 and a first-stage buffer chamber A9 in sequential communication, as well as a second-stage high-pressure side passage A12, a second-stage throttle valve A13 and a second-stage buffer chamber A14 in sequential communication, and the first-stage high-pressure side passage A7 is not in communication with the second-stage high-pressure side passage A12; the first-stage high-pressure side passage A7 is configured as a strip-shaped passage extending in a length direction of the base plate 3, the second-stage high-pressure side passage A12 is quasi-L-shaped, and the first-stage high-pressure side passage A7 is located in a region enclosed by a horizontal segment and a vertical segment of the second-stage high-pressure side passage A12, so as to increase an overlapping area (i.e., an effective area of a heat exchanger) of the first-stage working fluid in the first-stage low-pressure side passage A11 and the second-stage working fluid in the second-stage high-pressure side passage A12, and enhance the centralized precooling effect of the first-stage working fluid on the second-stage working fluid; a top end, i.e., an inlet end, of the first-stage high-pressure side passage A7 is simultaneously in communication with the first-stage working fluid inlets A1 on the base plate 1 and the base plate 2, and should avoid corresponding regions of the base plate 1 provided with the second-stage working fluid inlet A3, the third-stage working fluid inlet A5, the first-stage working fluid outlet A2, the second-stage working fluid outlet A4 and the third-stage working fluid outlet A6, and the first-stage buffer chamber A9 is in communication with the first-stage strip-shaped through hole A10 on the base plate 2; a top end, i.e., an inlet end, of the second-stage high-pressure side passage A12 is in communication with the second-stage working fluid inlet A3 on the base plate 1, and should avoid corresponding regions of the base plate 1 provided with the first-stage working fluid inlet A1, the third-stage working fluid inlet A5, the first-stage working fluid outlet A2, the second-stage working fluid outlet A4 and the third-stage working fluid outlet A6; a flow deflector A23 configured to adjust a flow direction of the second-stage working fluid in the second-stage high-pressure side passage A12 is provided in the horizontal segment of the second-stage high-pressure side passage A12, and a region of the base plate 3 where the second-stage buffer chamber A14 is located should completely cover a region of the second base plate 2 where the second-stage strip-shaped through hole A15 is located, such that the second-stage working fluid may smoothly flow into the second-stage low-pressure side passage without influencing circulation of other working fluids.

A top end of the base plate 4 is provided with one through hole serving as a third-stage working fluid inlet A5, the base plate 4 is further provided with a third-stage low-pressure side passage A21 and a third-stage strip-shaped through hole A20 which is in communication with an inlet end of the third-stage low-pressure side passage A21 and defined in a width direction of the base plate 4, two ends of the third-stage low-pressure side passage A21 extend towards two ends of the base plate 4 as far as possible, and a top end of the third-stage low-pressure side passage A21 should avoid corresponding regions of the base plate 1 provided with the first-stage working fluid inlet A1, the second-stage working fluid inlet A3, the third-stage working fluid inlet A5, the first-stage working fluid outlet A2 and the second-stage working fluid outlet A4.

The base plate 5 is provided with a third-stage high-pressure side passage A17, a third-stage throttle valve A18 and a third-stage buffer chamber A19 in sequential communication, an inlet end of the third-stage high-pressure side passage A17 is simultaneously in communication with the third-stage working fluid inlets A5 on the base plates 1-4, a top end of the third-stage high-pressure side passage A17 should avoid corresponding regions of the base plate 1 provided with the first-stage working fluid inlet A1, the second-stage working fluid inlet A3, the first-stage working fluid outlet A2, the second-stage working fluid outlet A4 and the third-stage working fluid outlet A6, the third-stage buffer chamber A19 is in communication with a third-stage strip-shaped through hole A20 on the base plate 4, and a region where the third-stage buffer chamber A19 is located should completely cover a region where the third-stage strip-shaped through hole A20 is located, such that the third-stage working fluid may smoothly flow into the third-stage low-pressure side passage without influencing the circulation of other working fluids.

The corresponding working fluid inlet and the corresponding working fluid outlet are arranged at same positions on each base plate.

The low-pressure side passage and the high-pressure side passage of each stage have widths far greater than depths of respective passages, and selection of the width and the depth depends on a pressure of the working fluid borne by the passage and a requirement for a cooling capacity of the cryocooler. A fin structure is required to be provided in the high-pressure side passage of each stage, the low-pressure side passage of each stage and the buffer chamber of each stage, and configured to, on the one hand, control a stress distribution in the passage, such that the cryocooler may bear a higher pressure, and on the other hand, control the flow and heat exchange in the passage to improve a performance of the cryocooler; a cross section of the fin structure has a shape of a rectangle, a circle, an ellipse, a diamond, a hydrofoil, or the like, and a size between several micrometers and tens of micrometers; the corresponding high-pressure side passage and the corresponding low-pressure passage form a dividing wall type heat exchanger to play a role of heat recovery, and in addition, the low-pressure side passage of each stage has functions of a precooler and an evaporator.

The buffer chamber of each stage has a depth consistent with a depth of the corresponding high-pressure side passage, such that a processing operation is convenient; the buffer chamber of each stage has a width slightly greater than a width of the strip-shaped through hole on the corresponding base plate, such that the fluid in the buffer chamber may conveniently pass through the strip-shaped through hole of the corresponding base plate.

In order to reduce heat conduction loss from a hot end to a cold end, each base plate in the miniature Joule-Thomson cryocooler A operating at liquid helium temperatures is made of a material with a small heat conduction coefficient, such as glass, polymers, ceramics, or the like. Optionally, the passages on each of the base plates 1-5 may be implemented by means of chemical etching, electron beam micro-processing, ion beam micro-processing, laser micro-processing, and LIGA processing (i.e., photolithography, electroforming and injection molding). In the present embodiment, the chemical etching method is preferred for the processing operation (for specific process parameters of the chemical etching method, seeing Iliescu C, Tay F E H, Miao J M, Strategies in deep wet etching of Pyrex glass, Sensors and Actuators A Physical, 2007, 133, 395-400). Compared with other processing methods, the chemical etching method facilitates realization of industrial mass production, and compared with the LIGA technology, the chemical etching method has a greater processing size range and higher precision. After the passage is processed, the five base plates may be welded using a welding technology (such as vacuum diffusion welding for bonding between glass and glass, and anodic welding for bonding between a silicon base plate and glass, the technologies being conventional processing technologies in the field) suitable for the selected material of the base plate.

In the present Joule-Thomson cryocooler, the flow passages of the first-stage working fluid and the second-stage working fluid are processed on the same base plate, thus reducing a size of the Joule-Thomson cryocooler, and saving materials; but a cooling efficiency of the cryocooler may be reduced due to the reduction of areas of the flow passages of the first-stage working fluid and the second-stage working fluid, and the heat conduction loss may be reduced by reducing thicknesses of the base plate 2 and the base plate 3, so as to guarantee the cooling efficiency of the Joule-Thomson cryocooler. In the present embodiment, the flow passages of the first-stage working fluid and the second-stage working fluid are processed on the same base plate, and similarly, the flow passages of the second-stage working fluid and the third-stage working fluid may also be processed on the same base plate, which is described later in detail in the fourth embodiment.

The miniature Joule-Thomson cryocooler A operating at liquid helium temperatures according to the present embodiment has three stages of circulation passages:

the first-stage working fluid is a working fluid capable of achieving a Joule-Thomson cooling effect without a precooling operation, and flows in the first-stage circulation passage, and a flow path thereof is as follows: the first-stage working fluid inlet A1→the first-stage high-pressure side passage A7→the first-stage throttle valve A8→the first-stage buffer chamber A9→the first-stage strip-shaped through hole A10→the first-stage low-pressure side passage A11→the first-stage working fluid outlet A2. The gas-phase first-stage working fluid in a high-pressure state flows into the first-stage high-pressure side passage A7 through the first-stage working fluid inlets A1 on the base plate 1 and the base plate 2 for a heat exchange, flows through the first-stage throttle valve A8 for Joule-Thomson expansion cooling, and then flows into the first-stage low-pressure side passage A11 through the first-stage buffer chamber A9 and the first-stage strip-shaped through hole A10 for a heat exchange with gas in the first-stage high-pressure side passage A7; in a stable state, the first-stage working fluid in the first-stage low-pressure side passage A11 has a gas phase and a liquid phase, the liquid phase absorbs heat to be gasified to achieve purposes of cooling and precooling the second-stage working fluid and the third-stage working fluid, and the gasified first-stage working fluid is discharged from the first-stage working fluid outlet A2 to complete one cycle.

The second-stage working fluid is neon or hydrogen, and flows in the second-stage circulation passage, and the flow path thereof is as follows: the second-stage working fluid inlet A3→the second-stage high-pressure side passage A12→the second-stage throttle valve A13→the second-stage buffer chamber A14→the second-stage strip-shaped through hole A15→the second-stage low-pressure side passage A16→the second-stage working fluid outlet A4. The gas-phase second-stage working fluid in a high-pressure state flows into the second-stage high-pressure side passage A12 through the second-stage working fluid inlets A3 on the base plate 1 and the base plate 2, and is precooled by cold energy generated by the first-stage working fluid in the second-stage high-pressure side passage A12, and after a temperature of the second-stage working fluid before flowing into the second-stage throttle valve A13 is lower than a transition temperature of the second-stage working fluid, the second-stage working fluid generates a cooling effect through throttle expansion, and then flows into the second-stage low-pressure side passage A16 through the second-stage buffer chamber A14 and the second-stage strip-shaped through hole A15 for a heat exchange with gas in the second-stage high-pressure side passage A12; in a stable state, the second-stage working fluid in the second-stage low-pressure side passage A16 has a gas phase and a liquid phase, the liquid phase absorbs heat to be gasified to achieve purposes of cooling and precooling the third-stage working fluid, and the gasified second-stage working fluid is discharged from the second-stage working fluid outlet A4 to complete one cycle.

The third-stage working fluid is helium, and flows in the third-stage circulation passage, and a flow path thereof is as follows: the third-stage working fluid inlet A5→the third-stage high-pressure side passage A17→the third-stage throttle valve A18→the third-stage buffer chamber A19→the third-stage strip-shaped through hole A20→the third-stage low-pressure side passage A21→the third-stage working fluid outlet A6. The gas-phase third-stage working fluid in a high-pressure state flows into the third-stage high-pressure side passage A17 through the third-stage working fluid inlets A5 on the base plates 1-4, and is precooled by cold energy generated by the first-stage working fluid and the second-stage working fluid in the third-stage high-pressure side passage A17, and after a temperature of the third-stage working fluid before flowing into the third-stage throttle valve A18 is lower than a transition temperature of the third-stage working fluid, the third-stage working fluid generates a cooling effect through throttle expansion, and then flows into the third-stage low-pressure side passage A21 through the third-stage buffer chamber A19 and the third-stage strip-shaped through hole A20 for a heat exchange with gas in the third-stage high-pressure side passage A17; in a stable state, the third-stage working fluid in the third-stage low-pressure side passage A21 has a gas phase and a liquid phase, the liquid phase absorbs heat to be gasified to achieve a cooling purpose, and the gasified third-stage working fluid is discharged from the third-stage working fluid outlet A6 to complete one cycle.

Preferably, the base plate provided with the low-pressure side passage in the third-stage cooling circulator is arranged on the outermost side to reduce a thermal resistance with a cooled device.

In summary, with this design, the first-stage and second-stage low-pressure side passages on the base plate 2 have triple functions of a heat exchanger, a precooler and an evaporator, and the low-pressure side passage on the base plate 4 has double functions of a heat exchanger and an evaporator, such that the cryocooler has a more compact structure.

Fourth Embodiment

Figure 6:
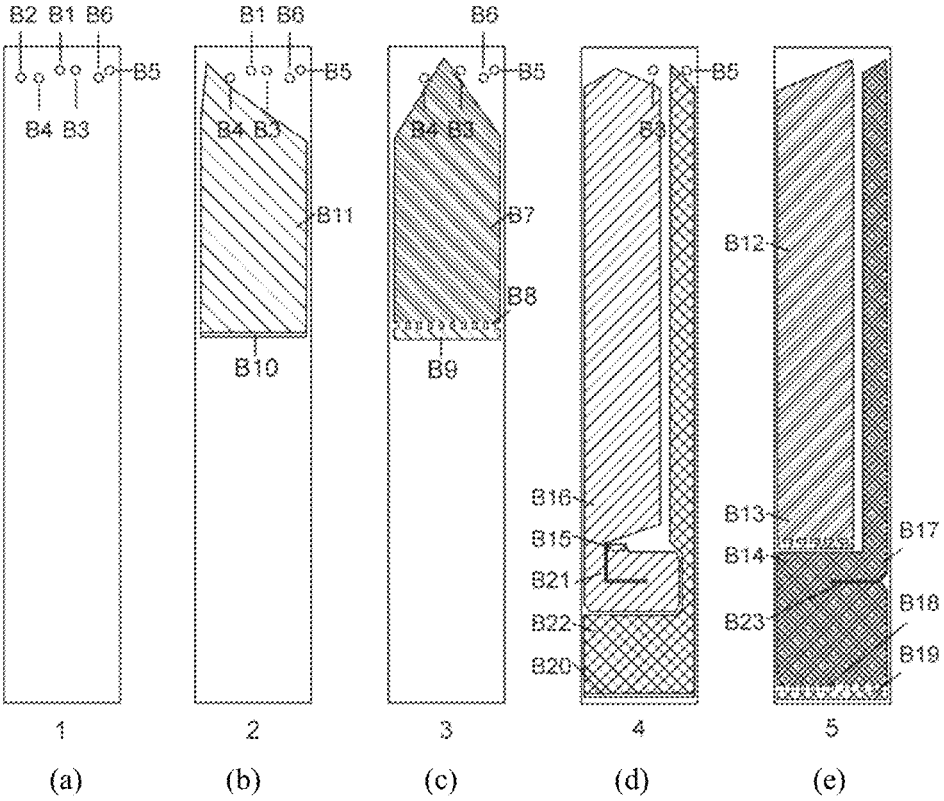
FIGS. 6(*a*) to 6(*e*) are schematic views of internal structures of base plates 1-5 in a miniature Joule-Thomson cryocooler B operating at liquid helium temperatures according to a fourth embodiment of the present invention.

FIG. 6 is a schematic diagram of an internal structure of a miniature Joule-Thomson cryocooler B operating at liquid helium temperatures according to a fourth embodiment of the present invention. The Joule-Thomson cryocooler B has an integral structure formed by welding five base plates sequentially superposed 1-5, the base plate 2 and the base plate 3 form a first-stage cooling circulator, and the base plate 4 and the base plate 5 form a second-stage cooling circulator and a third-stage cooling circulator.

A top end of the base plate 1 is provided with six through holes serving as a first-stage working fluid inlet B1, a second-stage working fluid inlet B3, a third-stage working fluid inlet B5, a first-stage working fluid outlet B2, a second-stage working fluid outlet B4 and a third-stage working fluid outlet B6 respectively.

A top end of the base plate 2 is provided with five through holes serving as a first-stage working fluid inlet B1, a second-stage working fluid inlet B3, a third-stage working fluid inlet B5, a second-stage working fluid outlet B4 and a third-stage working fluid outlet B6 respectively; the base plate 2 is also provided with a first-stage low-pressure side passage B11 and a first-stage strip-shaped through hole B10 in communication, and a top end, i.e., an outlet end, of the first-stage low-pressure side passage B11 is in communication with the first-stage working fluid outlet B2 on the base plate 1, and should avoid regions of the top end of the base plate 2 provided with the five through holes.

A top end of the base plate 3 is provided with four through holes serving as a second-stage working fluid inlet B3, a third-stage working fluid inlet B5, a second-stage working fluid outlet B4 and a third-stage working fluid outlet B6 respectively; the base plate 3 is also provided with a first-stage high-pressure side passage B7, a first-stage throttle valve B8 and a first-stage buffer chamber B9 in sequential communication, and a top end, i.e., an inlet end, of the first-stage high-pressure side passage B7 is in communication with the first-stage working fluid inlets B1 on the base plate 1 and the base plate 2, and should avoid regions of the top end of the base plate 3 provided with the four through holes; a region where the first-stage buffer chamber B9 is located should completely cover a region where the first-stage strip-shaped through hole B10 is located, such that a first-stage working fluid may smoothly flow into the first-stage low-pressure side passage B11 without influencing circulation of other working fluids; a distance from a bottom end of the first-stage buffer chamber B9 to a bottom end of the base plate 3 determines heat exchange areas of the high-pressure and low-pressure side passages of the first-stage working fluid, and is required to be determined according to mass flow of the first-stage working fluid.

A top end of the base plate 4 is provided with two through holes serving as a second-stage working fluid inlet B3 and a third-stage working fluid inlet B5 respectively; the base plate 4 is also provided with a second-stage low-pressure side passage B16 and a third-stage low-pressure side passage B22 not in communication, and each of the second-stage low-pressure side passage B16 and the third-stage low-pressure side passage B22 at least has two oppositely arranged side surfaces; in the present embodiment, the second-stage low-pressure side passage B16 and the third-stage low-pressure side passage B22 are arranged opposite to each other and have a quasi-L-shaped cross section, and a side wall of a vertical segment of the third-stage low-pressure side passage B22 is recessed to accommodate an end portion of a horizontal segment of the second-stage low-pressure side passage B16, such that the following oppositely arranged side walls are provided between the second-stage low-pressure side passage B16 and the third-stage low-pressure side passage B22: a side wall of a vertical segment of the second-stage low-pressure side passage B16 and the side wall of the vertical segment of the third-stage low-pressure side passage B22, as well as a side wall of the horizontal segment of the second-stage low-pressure side passage B16 and a side wall of a horizontal segment of the third-stage low-pressure side passage B22; this structural design may increase a heat exchange area of a second-stage working fluid in the second-stage low-pressure side passage B16 and a third-stage working fluid in a third-stage high-pressure side passage B17 on the base plate 5, so as to achieve a centralized precooling effect of the second-stage working fluid on the third-stage working fluid; a second-stage strip-shaped through hole B15 is defined at a junction of the horizontal segment and the vertical segment of the second-stage low-pressure side passage B16, i.e., the inlet end of the second-stage low-pressure side passage B16, and a second-stage flow deflector B21 connected with the second-stage strip-shaped through hole B15 is provided in the horizontal segment of the second-stage low-pressure side passage B16 and configured to adjust a flow direction of the second-stage working fluid in the second-stage low-pressure side passage B16, so as to prolong a length of a flow passage of the second-stage working fluid from the second-stage strip-shaped through hole B15 flowing through this region, strengthen a heat exchange between the first-stage working fluid in the second-stage low-pressure side passage B16 and the third-stage working fluid in the third-stage high-pressure side passage B17, and strengthen the centralized precooling effect of the second-stage working fluid on the third-stage working fluid. An outlet end of the second-stage low-pressure side passage B16 is in communication with the second-stage working fluid outlets B4 on the base plates 1-3, and should avoid corresponding regions of the base plate 1 provided with the first-stage working fluid inlet B1, the second-stage working fluid inlet B3, the third-stage working fluid inlet B5, the first-stage working fluid outlet B2 and the third-stage working fluid outlet B6. A top end, i.e., an inlet end, of the third-stage low-pressure side passage B22 is in communication with the third-stage working fluid outlets B6 on the base plates 1-3, and should avoid corresponding regions of the base plate 1 provided with the first-stage working fluid inlet B1, the second-stage working fluid inlet B3, the third-stage working fluid inlet B5, the first-stage working fluid outlet B2 and the second-stage working fluid outlet B4; a bottom end of a third-stage strip-shaped through hole B20 should be as close to a bottom end of the base plate 4 as possible.

The base plate 5 is provided with a second-stage high-pressure side passage B12, a second-stage throttle valve B13 and a second-stage buffer chamber B14 in sequential communication, as well as a third-stage high-pressure side passage B17, a third-stage throttle valve B18 and a third-stage buffer chamber B19 in sequential communication, and the second-stage high-pressure side passage B12 is not in communication with the third-stage high-pressure side passage B17. An inlet end of the second-stage high-pressure side passage B12 is in communication with the second-stage working fluid inlets B3 on the base plates 1-4, and should avoid corresponding regions of the base plate 1 provided with the first-stage working fluid inlet B1, the third-stage working fluid inlet B5, the first-stage working fluid outlet B2, the second-stage working fluid outlet B4 and the third-stage working fluid outlet B6; a region where the second-stage buffer chamber B14 is located should completely cover a region where the second-stage strip-shaped through hole B15 is located, such that the second-stage working fluid may smoothly flow into the second-stage low-pressure side passage B16 without influencing circulation of other working fluids. Each of the second-stage high-pressure side passage B12 and the third-stage high-pressure side passage B17 at least has two oppositely arranged side surfaces; in the present embodiment, the second-stage high-pressure side passage B12 and the third-stage high-pressure side passage B17 are arranged opposite to each other, the second-stage high-pressure side passage B12 is configured as a quasi-rectangular passage extending in a length direction of the base plate 5, and the third-stage high-pressure side passage B17 has a quasi-L-shaped cross section, such that the following oppositely arranged side walls are provided between the second-stage high-pressure side passage B12 and the third-stage high-pressure side passage B17: a side wall of a vertical segment of the second-stage high-pressure side passage B12 and a side wall of a vertical segment of the third-stage high-pressure side passage B17, as well as a horizontal side wall of a bottom of the second-stage high-pressure side passage B12 and a top wall of a horizontal segment of the third-stage high-pressure side passage B17; this structural design may increase an overlapping area (i.e., an effective area of a heat exchanger) of the second-stage working fluid in the second-stage low-pressure side passage B16 and the third-stage working fluid in the third-stage high-pressure side passage B17, thus strengthening the centralized precooling effect of the second-stage working fluid on the third-stage working fluid. A top end, i.e., an inlet end, of the third-stage high-pressure side passage B17 is in communication with the third-stage working fluid inlets B5 on the base plates 1-4, and should avoid corresponding regions of the base plate 1 provided with the first-stage working fluid inlet B1, the second-stage working fluid inlet B3, the first-stage working fluid outlet B2, the second-stage working fluid outlet B4 and the third-stage working fluid outlet B6; a third-stage flow deflector B23 is provided in the horizontal segment of the third-stage high-pressure side passage B17 close to the second-stage buffer chamber B14 and configured to adjust a flow direction of the third-stage working fluid in the third-stage high-pressure side passage B17; a region where the third-stage buffer chamber B19 is located should completely cover a region where the third-stage strip-shaped through hole B20 is located, such that the third-stage working fluid may smoothly flow into the third-stage low-pressure side passage without influencing circulation of other working fluids.

For a specific implementation of each device in the miniature Joule-Thomson cryocooler B operating at liquid helium temperatures and a circulating path of the working fluid of each stage, reference is made to the miniature Joule-Thomson cryocooler A operating at liquid helium temperatures, which are not repeated herein.

Fifth Embodiment

Figure 7:
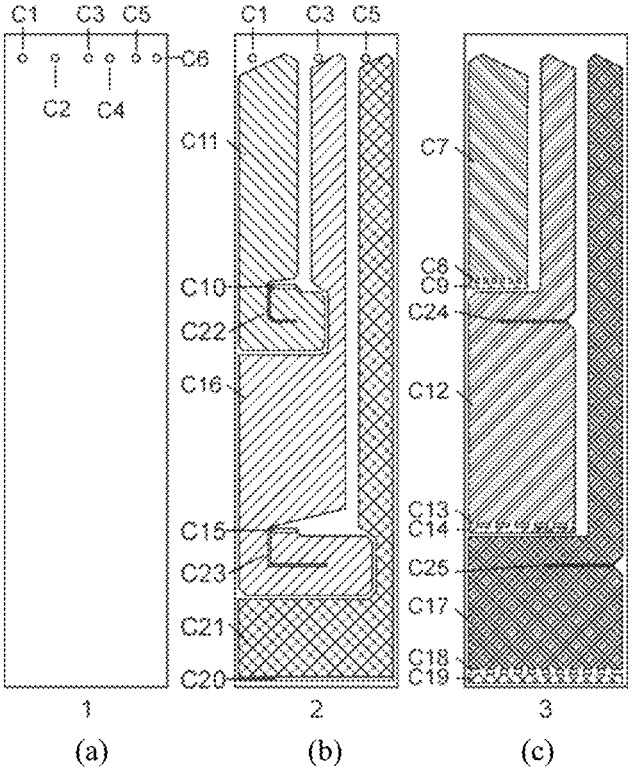
FIGS. 7(*a*) to 7(*c*) are schematic views of internal structures of base plates 1-3 in a miniature Joule-Thomson cryocooler C operating at liquid helium temperatures according to a fifth embodiment of the present invention.

FIG. 7 is a schematic diagram of an internal structure of a miniature Joule-Thomson cryocooler C operating at liquid helium temperatures according to a fifth embodiment of the present invention, and the Joule-Thomson cryocooler C has an integral structure formed by welding three base plates sequentially superposed 1-3.

The base plate 1 serves as a cover plate to seal the rest of the three base plates, and the base plates 2, 3 form a first-stage cooling circulator, a second-stage cooling circulator and a third-stage cooling circulator.

A top end of the base plate 1 is provided with six through holes serving as a first-stage working fluid inlet C1, a second-stage working fluid inlet C3, a third-stage working fluid inlet C5, a first-stage working fluid outlet C2, a second-stage working fluid outlet C4 and a third-stage working fluid outlet C6 respectively.

A top end of the base plate 2 is provided with three through holes serving as a first-stage working fluid inlet C1, a second-stage working fluid inlet C3 and a third-stage working fluid inlet C5 respectively. The base plate 2 is further provided with a first-stage low-pressure side passage C11 and a first-stage strip-shaped through hole C10 in communication, a second-stage low-pressure side passage C16 and a second-stage strip-shaped through hole C15 in communication, as well as a third-stage low-pressure side passage C21 and a third-stage strip-shaped through hole C20 in communication, and the low-pressure side passages of all stages are not in communication; at least two oppositely arranged side surfaces are provided between the first-stage low-pressure side passage C11 and the second-stage low-pressure side passage C16, and at least two oppositely arranged side surfaces are provided between the second-stage low-pressure side passage C16 and the third-stage low-pressure side passage C21; in the present embodiment, each of the first-stage, second-stage and third-stage low-pressure side passages has a quasi-L-shaped cross section, top ends, i.e., outlet ends, of the first-stage, second-stage and third-stage low-pressure side passages are arranged close to the top end of the base plate 2, the first-stage and second-stage low-pressure side passages are arranged opposite to each other, a side wall of a vertical segment of the second-stage low-pressure side passage C16 is recessed to accommodate an end portion of a horizontal segment of the first-stage low-pressure side passage C11, and the end portion of the horizontal segment of the first-stage low-pressure side passage C11 is designed to increase a heat exchange area of a first-stage working fluid in the first-stage low-pressure side passage C11 and a second-stage working fluid in a high-pressure side passage C12, so as to achieve a centralized precooling effect of the first-stage working fluid on the second-stage working fluid. The first-stage strip-shaped through hole C10 is defined at a junction of the horizontal segment and a vertical segment of the first-stage low-pressure side passage C11, i.e., an inlet end of the first-stage low-pressure side passage C11, and a flow deflector C22 connected with the first-stage strip-shaped through hole C10 is provided in the horizontal segment of the first-stage low-pressure side passage C11 and configured to adjust a flow direction of the first-stage working fluid in the first-stage low-pressure side passage C11, so as to prolong a length of a flow passage of the first-stage working fluid from the first-stage strip-shaped through hole C10 flowing through this region, strengthen a heat exchange between the first-stage working fluid in the first-stage low-pressure side passage C11 and the second-stage working fluid in the first-stage high-pressure side passage C12, and strengthen the centralized precooling effect of the first-stage working fluid on the second-stage working fluid. The outlet end of the first-stage low-pressure side passage C11 is in communication with the first-stage working fluid outlet C2 on the base plate 1, and the top end of the first-stage low-pressure side passage C11 should avoid corresponding regions of the base plate 1 provided with the first-stage working fluid inlet C1, the second-stage working fluid inlet C3, the third-stage working fluid inlet C5, the second-stage working fluid outlet C4 and the third-stage working fluid outlet C6. A bottom end of the second-stage low-pressure side passage C16 extends in a width direction of the base plate 2 to form a protruding portion and extends into a recess of a side wall of a vertical segment of the third-stage low-pressure side passage C21, the second-stage strip-shaped through hole C15 is provided at the protruding portion, and the protruding portion is provided therein with a flow deflector C23 which is connected with the second-stage strip-shaped through hole C15 and configured to adjust a flow direction of the second-stage working fluid in the second-stage low-pressure side passage C16; the outlet end of the second-stage low-pressure side passage C16 is in communication with the second-stage working fluid outlet C4 on the base plate 1, and the top end of the second-stage low-pressure side passage C16 should avoid corresponding regions of the base plate 1 provided with the first-stage working fluid inlet C1, the second-stage working fluid inlet C3, the third-stage working fluid inlet C5 and the third-stage working fluid outlet C6. The top end, i.e., the outlet end, of the third-stage low-pressure side passage C21 is in communication with the third-stage working fluid outlet C6 on the base plate 1, and should avoid corresponding regions of the base plate 1 provided with the first-stage working fluid inlet C1, the second-stage working fluid inlet C3, the third-stage working fluid inlet C5, the first-stage working fluid outlet C2 and the second-stage working fluid outlet C4; a bottom end of the third-stage strip-shaped through hole C20 should be as close to a bottom end of the base plate 2 as possible.

The base plate 3 is provided with a first-stage high-pressure side passage C7, a first-stage throttle valve C8 and a first-stage buffer chamber C9 in sequential communication, a second-stage high-pressure side passage C12, a second-stage throttle valve C13 and a second-stage buffer chamber C14 in sequential communication, as well as a third-stage high-pressure side passage C17, a third-stage throttle valve C18 and a third-stage buffer chamber C19 in sequential communication, and the high-pressure side passages of all stages are not in communication. A top end, i.e., an inlet end, of the first-stage high-pressure side passage C7 is in communication with the first-stage working fluid inlets C1 on the base plates 1, 2, and should avoid corresponding regions of the base plate 1 provided with the second-stage working fluid inlet C3, the third-stage working fluid inlet C5, the first-stage working fluid outlet C2, the second-stage working fluid outlet C4 and the third-stage working fluid outlet C6; a top end, i.e., an inlet end, of the second-stage high-pressure side passage C12 is in communication with the second-stage working fluid inlets C3 on the base plates 1, 2, and should avoid corresponding regions of the base plate 1 provided with the first-stage working fluid inlet C1, the third-stage working fluid inlet C5, the first-stage working fluid outlet C2, the second-stage working fluid outlet C4 and the third-stage working fluid outlet C6; a top end, i.e., an inlet end, of the third-stage high-pressure side passage C17 is in communication with the third-stage working fluid inlets C5 on the base plates 1, 2, and should avoid corresponding regions of the base plate 1 provided with the first-stage working fluid inlet C1, the second-stage working fluid inlet C3, the first-stage working fluid outlet C2, the second-stage working fluid outlet C4 and the third-stage working fluid outlet C6. At least two oppositely arranged side surfaces are provided between the first-stage high-pressure side passage C7 and the second-stage high-pressure side passage C12, and at least two oppositely arranged side surfaces are provided between the second-stage high-pressure side passage C12 and the third-stage high-pressure side passage C17; in the present embodiment, the first-stage high-pressure side passage C7 is configured as a strip-shaped passage extending in a length direction of the base plate 3, and the second-stage high-pressure side passage C12 and the third-stage high-pressure side passage C17 are both quasi-L-shaped; the first-stage high-pressure side passage C7 is located in a region enclosed by a horizontal segment and a vertical segment of the second-stage high-pressure side passage C12, so as to increase an overlapping area (i.e., an effective area of a heat exchanger) of the first-stage working fluid in the first-stage low-pressure side passage C11 and the second-stage working fluid in the high-pressure side passage C12, and enhance the centralized precooling effect of the first-stage working fluid on the second-stage working fluid. A region where the first-stage buffer chamber C9 is located should completely cover a region where the first-stage strip-shaped through hole C10 is located, such that the first-stage working fluid may smoothly flow into the first-stage low-pressure side passage without influencing circulation of other working fluids; a flow deflector C24 configured to adjust a flow direction of the second-stage working fluid in the second-stage high-pressure side passage C12 is provided in the horizontal segment of the second-stage high-pressure side passage C12 close to the first-stage buffer chamber C9; a region where the second-stage buffer chamber C14 is located should completely cover a region where the second-stage strip-shaped through hole C15 is located, such that the second-stage working fluid may smoothly flow into the second-stage low-pressure side passage without influencing circulation of other working fluids; a flow deflector C25 configured to adjust a flow direction of the third-stage working fluid in the third-stage high-pressure side passage C17 is provided in the horizontal segment of the third-stage high-pressure side passage C17 close to the second-stage buffer chamber C14; a region where the third-stage buffer chamber C19 is located should completely cover a region where the third-stage strip-shaped through hole C20 is located, such that the third-stage working fluid may smoothly flow into the third-stage low-pressure side passage without influencing circulation of other working fluids.

Compared with the miniature Joule-Thomson cryocooler A operating at liquid helium temperatures and the miniature Joule-Thomson cryocooler B operating at liquid helium temperatures, the miniature Joule-Thomson cryocooler C operating at liquid helium temperatures further saves processing materials, and resulting reduction of a cooling efficiency may be solved by reducing a thickness of each base plate.

For a specific implementation of each device in the miniature Joule-Thomson cryocooler C operating at liquid helium temperatures and a flow path of the working fluid of each stage, reference is made to the miniature Joule-Thomson cryocooler A operating at liquid helium temperatures, which are not repeated herein.

In other embodiments of the present invention, the base plates in the cooling circulator of each stage provided with the high-pressure side passage and the low-pressure side passage may have interchangeable positions; that is, the base plate provided with the high-pressure side passage may be located above the base plate provided with the low-pressure side passage. At this point, the buffer chamber at the bottom end of the high-pressure side passage is provided with a through hole directly facing the inlet end of the low-pressure side passage, and the low-pressure side passage should completely cover the region where the buffer chamber is located.

The present invention and its embodiments are schematically described above, and the description is not restrictive; what is shown in the drawings is only one of the embodiments of the invention and is not actually limited thereto. Therefore, if those skilled in the art gain enlightenment from the description to non-creatively devise similar modes and embodiments to the technical solution without departing from the spirit of the present invention, these modes and embodiments shall all fall within the protection scope of the present invention.

What is claimed is:

1. A miniature Joule-Thomson cryocooler operating at liquid helium temperatures, comprising an integral structure formed by welding at least three base plates sequentially superposed, wherein an outermost base plate in the at least three base plates is configured as a cover plate and configured to seal the rest of the at least three base plates, the rest of the at least three base plates is configured as a first-stage cooling circulator, a second-stage cooling circulator and a third-stage cooling circulator respectively, the first-stage cooling circulator, the second-stage cooling circulator and the third-stage cooling circulator have a first-stage working fluid, a second-stage working fluid and a third-stage working fluid respectively, the first-stage cooling circulator is configured to precool the second-stage working fluid and the third-stage working fluid through the first-stage working fluid, and the second-stage cooling circulator is configured to precool the third-stage working fluid through the second-stage working fluid; and wherein:

the integral structure is formed by welding seven base plates sequentially superposed; in the seven base plates, a first base plate serves as the cover plate, a second base plate and a third base plate form the first-stage cooling circulator, a fourth base plate and a fifth base plate form the second-stage cooling circulator, and a sixth base plate and a seventh base plate form the third-stage cooling circulator;

a top end of the first base plate is provided with six through holes serving as a first-stage working fluid inlet, a second-stage working fluid inlet, a third-stage working fluid inlet, a first-stage working fluid outlet, a second-stage working fluid outlet and a third-stage working fluid outlet respectively; a top end of the second base plate is provided with five through holes serving as a first-stage working fluid inlet, a second-stage working fluid inlet, a third-stage working fluid inlet, a second-stage working fluid outlet and a third-stage working fluid outlet respectively; a top end of the third base plate is provided with four through holes serving as a second-stage working fluid inlet, a third-stage working fluid inlet, a second-stage working fluid outlet and a third-stage working fluid outlet respectively; a top end of the fourth base plate is provided with three through holes serving as a second-stage working fluid inlet, a third-stage working fluid inlet and a third-stage working fluid outlet respectively; a top end of the fifth base plate is provided with two through holes serving as a third-stage working fluid inlet and a third-stage working fluid outlet respectively; a top end of the sixth base plate is provided with one through hole serving as a third-stage working fluid inlet; the working fluid outlets and the working fluid inlets of the same type are arranged at same positions on the corresponding base plates;

each of the third base plate, the fifth base plate and the seventh base plate is provided with a high-pressure side passage, a throttle valve and a buffer chamber in sequential communication, and an inlet end of each high-pressure side passage is in communication with the working fluid inlet of a corresponding stage; and each of the second base plate, the fourth base plate and the sixth base plate is provided with a low-pressure side passage, and each low-pressure side passage has an inlet end in communication with the buffer chamber of a corresponding stage, and an outlet end in communication with the working fluid outlet of a corresponding stage; and the low-pressure side passages on the second base plate and the fourth base plate have functions of a heat exchanger, a precooler and an evaporator, and the low-pressure side passage on the sixth base plate has functions of a heat exchanger and an evaporator.

2. The miniature Joule-Thomson cryocooler operating at liquid helium temperatures according to claim 1, wherein the first-stage cooling circulator and the second-stage cooling circulator are located between the first base plate and the third-stage cooling circulator, and the first-stage cooling circulator and the second-stage cooling circulator have interchangeable positions.

3. The miniature Joule-Thomson cryocooler operating at liquid helium temperatures according to claim 1, wherein each buffer chamber has a width slightly greater than a width of a strip-shaped through hole in a corresponding base plate.

4. The miniature Joule-Thomson cryocooler operating at liquid helium temperatures according to claim 1, wherein each of the first base plate, the second base plate and the third base plate is provided with a through hole serving as an additional first-stage working fluid inlet;

the second base plate is further provided with an additional first-stage low-pressure side passage, and the additional first-stage low-pressure side passage has an outlet end in communication with the inlet end of the low-pressure side passage on the second base plate; and the third base plate is further provided with an additional first-stage high-pressure side passage, an additional first-stage throttle valve and an additional first-stage buffer chamber in communication, the additional first-stage high-pressure side passage has a top end in communication with each additional first-stage working fluid inlet through an upward extending passage, and the additional first-stage buffer chamber is in communication with an inlet end of the additional first-stage low-pressure side passage on the second base plate.

5. The miniature Joule-Thomson cryocooler operating at liquid helium temperatures according to claim 1, wherein in the cooling circulator of each stage, when the low-pressure side passage is located above the high-pressure side passage, the buffer chamber is in communication with the inlet end of the low-pressure side passage through a strip-shaped through hole formed in a bottom end of the low-pressure side passage; when the low-pressure side passage is located below the high-pressure side passage, a through hole directly facing to the inlet end of the low-pressure side passage is formed in the buffer chamber, and the low-pressure side passage completely covers a region where the buffer chamber is located.

6. The miniature Joule-Thomson cryocooler operating at liquid helium temperatures according to claim 1, wherein the first-stage working fluid is a working fluid capable of achieving a Joule-Thomson cooling effect without a pre-cooling operation; the second-stage working fluid is neon or hydrogen; and the third-stage working fluid is helium.

7. The miniature Joule-Thomson cryocooler operating at liquid helium temperatures according to claim 1, wherein a fin structure is provided in each low-pressure side passage, each high-pressure side passage and each buffer chamber.

8. The miniature Joule-Thomson cryocooler operating at liquid helium temperatures according to claim 7, wherein a cross section of the fin structure has a shape of a rectangle, a circle, an ellipse, a diamond or a hydrofoil, and a size between several micrometers and tens of micrometers.

* * * * *